US006550633B2

(12) United States Patent
Huang et al.

(10) Patent No.: US 6,550,633 B2
(45) Date of Patent: Apr. 22, 2003

(54) PROCESS FOR JOINING WET WIPES TOGETHER AND PRODUCT MADE THEREBY

(75) Inventors: Yung Hsiang Huang, Appleton, WI (US); Jennifer Cappel Larson, Oshkosh, WI (US); Gerald Keith Sosalla, Appleton, WI (US); John C. Taylor, Grand Chute, WI (US); Stephen Michael Campbell, Winneconne, WI (US); Stephen Robert Kehn, Appleton, WI (US); Chinmay Suresh Betrabet, Corvallis, OR (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 44 days.

(21) Appl. No.: 09/870,815

(22) Filed: May 31, 2001

(65) Prior Publication Data

US 2002/0192433 A1 Dec. 19, 2002

(51) Int. Cl.[7] ..... A47K 10/24
(52) U.S. Cl. ..... 221/45; 428/40.1
(58) Field of Search ..... 221/53, 49, 48, 221/63, 45, 46; 206/494, 449, 812, 207, 215; 428/40.1, 43, 40.2, 126

(56) References Cited

U.S. PATENT DOCUMENTS

| | | | |
|---|---|---|---|
| 2,004,614 | A | 6/1935 | Meagher |
| 2,118,380 | A | 5/1938 | Gresenz |
| 2,323,395 | A | 7/1943 | Harwood |

(List continued on next page.)

FOREIGN PATENT DOCUMENTS

| | | | |
|---|---|---|---|
| CA | 996515 | | 9/1976 |
| EP | 0 223 262 | A2 | 5/1987 |
| EP | 0 068 722 | B1 | 4/1988 |
| EP | 0 331 027 | B1 | 1/1992 |
| EP | 0 744 357 | A1 | 11/1996 |
| EP | 0 644 130 | B1 | 5/1998 |
| EP | 1 023 863 | A1 | 8/2000 |
| GB | 793745 | | 4/1956 |
| WO | WO 00/44270 | | 8/2000 |
| WO | WO 00/65972 | A1 | 11/2000 |
| WO | WO 99/55599 | | 10/2001 |

OTHER PUBLICATIONS

American Society for Testing Materials (ASTM) Designation: D 412–98a, "Standard Test Methods for Vulcanized Rubber and Thermoplastic Elastomers—Tension," pp. 43–55, published Aug. 1998.

American Society for Testing Materials (ASTM) Designation: D 790–99, "Standard Test Methods for Flexural Properties of Unreinforced and Reinforced Plastics and Electrical Insulating Materials," pp. 150–158, published Feb. 2000.

American Society for Testing Materials (ASTM) Designation: D 2240–97, "Standard Test Method for Rubber Property—Durometer Hardness," pp. 400–403, published Mar. 1997.

American Society for Testing Materials (ASTM) Designation: D 6125–97, "Standard Test Method for Bending Resistance of Paper and Paperboard (Gurley Type Tester)," pp. 885–889, published Feb. 1998.

*Primary Examiner*—Kenneth W. Noland
(74) *Attorney, Agent, or Firm*—Michael J. Bendel

(57) ABSTRACT

The invention relates to a plurality of wipes, separable joined together. Each wipe of the plurality of wipes is moistened with a liquid in an amount of about 25 percent to about 600 percent of a dry weight of the wipe. An adhesive joins together at least two wipes of the plurality of wipes. The adhesive joins the at least two wipes together with an adhesion strength per unit adhesive length greater than 0 g/cm and less than about 200 g/cm. Alternately or additionally, the adhesive joins the at least two wipes together with an adhesion strength per unit adhesive area greater than 0 g/cm$^2$ and less than about 1000 g/cm$^2$.

49 Claims, 12 Drawing Sheets

U.S. PATENT DOCUMENTS

| | | | |
|---|---|---|---|
| 2,529,853 | A | 11/1950 | Taggart |
| 2,626,145 | A | 1/1953 | Sabee |
| 2,761,677 | A | 9/1956 | Rutkus et al. |
| 2,809,082 | A | 10/1957 | Marcuse |
| 2,823,089 | A | 2/1958 | De Franco |
| 2,890,791 | A | 6/1959 | Wenzel |
| 3,007,605 | A | 11/1961 | Donovan |
| 3,021,002 | A | 2/1962 | Guyer |
| 3,095,991 | A | 7/1963 | Paniagua |
| 3,160,337 | A | 12/1964 | Nelson |
| 3,161,336 | A | 12/1964 | Loescher |
| 3,172,563 | A | 3/1965 | Harwood |
| 3,239,097 | A | 3/1966 | Bates |
| 3,266,666 | A | 8/1966 | Nelson |
| 3,369,699 | A | 2/1968 | Enloe et al. |
| 3,490,645 | A | 1/1970 | Glass et al. |
| 3,576,243 | A | 4/1971 | Trunick |
| 3,679,094 | A | 7/1972 | Nissen et al. |
| 3,679,095 | A | 7/1972 | Nissen et al. |
| 3,700,138 | A | 10/1972 | Nelson |
| 3,749,296 | A | 7/1973 | Harrison |
| 3,780,908 | A | 12/1973 | Fitzpatrick et al. |
| 3,795,355 | A | 3/1974 | Gerstein |
| 3,836,044 | A | 9/1974 | Tilp et al. |
| 3,843,017 | A | 10/1974 | Harrison |
| 3,868,052 | A | 2/1975 | Rockefeller |
| 3,881,632 | A | 5/1975 | Early et al. |
| 3,973,695 | A | 8/1976 | Ames |
| 3,979,019 | A | 9/1976 | Bliss |
| 3,994,417 | A | 11/1976 | Boedecker |
| 4,002,264 | A | 1/1977 | Marchesani |
| 4,004,687 | A | 1/1977 | Boone |
| 4,009,682 | A | 3/1977 | Patel et al. |
| 4,017,002 | A | 4/1977 | Doyle et al. |
| 4,064,880 | A | 12/1977 | Logan |
| 4,100,324 | A | 7/1978 | Anderson et al. |
| 4,133,457 | A | 1/1979 | Klassen |
| 4,180,160 | A | 12/1979 | Ogawa et al. |
| 4,200,200 | A | 4/1980 | Hein, III et al. |
| 4,219,129 | A | 8/1980 | Sedgwick |
| 4,244,493 | A | 1/1981 | Harrison |
| 4,262,816 | A | 4/1981 | Margulies |
| 4,289,262 | A | 9/1981 | Finkelstein |
| 4,328,655 | A | 5/1982 | Spencer et al. |
| 4,328,907 | A | 5/1982 | Beard |
| 4,337,876 | A | 7/1982 | Thompson |
| 4,416,392 | A | 11/1983 | Smith |
| 4,458,810 | A | 7/1984 | Mahoney |
| 4,534,491 | A | 8/1985 | Norton et al. |
| 4,570,518 | A | 2/1986 | Burmeister et al. |
| 4,574,952 | A | 3/1986 | Masui |
| 4,611,728 | A | 9/1986 | Compton et al. |
| 4,623,074 | A | 11/1986 | Dearwester |
| 4,653,666 | A | 3/1987 | Mertens |
| 4,674,634 | A | 6/1987 | Wilson |
| 4,681,240 | A | 7/1987 | Wyant |
| 4,700,939 | A | 10/1987 | Hathaway |
| 4,721,295 | A | 1/1988 | Hathaway |
| 4,768,810 | A | 9/1988 | Mertens |
| 4,776,649 | A | 10/1988 | ten Wolde |
| 4,781,306 | A | 11/1988 | Smith |
| 4,784,290 | A | 11/1988 | Howard |
| 4,786,810 | A | 11/1988 | Shulman et al. |
| 4,848,575 | A | 7/1989 | Nakamura et al. |
| 4,854,984 | A | 8/1989 | Ball et al. |
| 4,859,518 | A | 8/1989 | Schutz |
| 4,863,064 | A | 9/1989 | Dailey, III. |
| 4,888,229 | A | 12/1989 | Paley et al. |
| 4,895,746 | A | 1/1990 | Mertens |
| 4,921,127 | A | 5/1990 | Windorski |
| 4,927,064 | A | 5/1990 | Burgin |
| 4,952,432 | A | 8/1990 | Ten Wolde |
| 4,986,440 | A | 1/1991 | Windorski |
| 4,993,590 | A | 2/1991 | Windorski |
| 5,033,620 | A | 7/1991 | De Luca |
| 5,050,909 | A | 9/1991 | Mertens et al. |
| 5,067,628 | A | 11/1991 | Evenson |
| 5,069,735 | A | 12/1991 | Reynolds |
| 5,076,424 | A | 12/1991 | Nakamura |
| 5,080,254 | A | 1/1992 | Feer |
| 5,080,255 | A | 1/1992 | Windorski |
| 5,118,554 | A | 6/1992 | Chan et al. |
| 5,152,121 | A | 10/1992 | Nakamura |
| 5,158,205 | A | 10/1992 | Bodziak et al. |
| 5,165,570 | A | 11/1992 | Windorski et al. |
| 5,167,346 | A | 12/1992 | Bodziak |
| 5,225,649 | A | 7/1993 | Andreoli et al. |
| 5,316,177 | A | 5/1994 | Boldt |
| 5,332,118 | A | 7/1994 | Muckenfuhs |
| 5,350,597 | A | 9/1994 | Pelley |
| 5,358,140 | A | 10/1994 | Pellegrino |
| 5,379,897 | A | 1/1995 | Muckenfuhs et al. |
| 5,497,903 | A | 3/1996 | Yoneyama |
| 5,516,001 | A | 5/1996 | Muckenfuhs et al. |
| 5,520,308 | A | 5/1996 | Berg, Jr. et al. |
| 5,542,567 | A | 8/1996 | Julius |
| 5,542,568 | A | 8/1996 | Julius |
| 5,605,731 | A | 2/1997 | Pubill |
| 5,642,835 | A | 7/1997 | Young et al. |
| 5,647,506 | A | 7/1997 | Julius |
| 5,704,471 | A | 1/1998 | Yamada |
| 5,729,955 | A | 3/1998 | Yamada |
| D395,952 | S | 7/1998 | Buczwinski et al. |
| 5,785,179 | A | 7/1998 | Buczwinski et al. |
| 5,810,200 | A | 9/1998 | Trokhan |
| 5,908,138 | A | 6/1999 | Vlahakis et al. |
| D414,637 | S | 10/1999 | Amundson et al. |
| 6,053,357 | A | 4/2000 | Yoh |
| 6,082,663 | A | 7/2000 | Tramontina et al. |
| 6,152,322 | A | 11/2000 | Marino |
| 6,182,858 | B1 | 2/2001 | Hartog |
| 6,286,712 | B1 | 9/2001 | Craig et al. |

PROCESS FOR JOINING WET WIPES TOGETHER AND PRODUCT MADE THEREBY

BACKGROUND OF THE INVENTION

Wipes have been made from a variety of materials which can be dry or wet when used. Wet wipes can be moistened with a variety of suitable wiping solutions. Typically, wet wipes have been stacked in a container in either a folded or unfolded configuration. For example, containers of wet wipes have been available wherein each of the wet wipes stacked in the container has been arranged in a folded configuration such as a c-folded, z-folded or quarter-folded configuration as are well known to those skilled in the art. Sometimes the folded wet wipes have also been interfolded with the wet wipes immediately above and below in the stack of wet wipes. In an alternative configuration, the wet wipes have been placed in the container in the form of a continuous web of material which includes perforations to separate the individual wet wipes and which can be wound into a roll. Such wet wipes have been used for baby wipes, hand wipes, household cleaning wipes, industrial wipes and the like.

The conventional packages which contain wipes, such as those described above, have typically been designed to be positioned on a flat surface such as a countertop, changing table or the like. Such conventional packages have generally provided a plastic container, tub or package which provides a sealed environment for the wet wipes to ensure that they do not become overly dry. Some of the conventional packages have also been configured to provide one at a time dispensing of each wet wipe which can be accomplished using a single hand after the package has been opened. Such single handed, one at a time dispensing, often referred to as "pop-up" dispensing, is particularly desirable because the other hand of the user or care giver is typically required to be simultaneously used for other functions. For example, when changing a diaper product on an infant, the care giver typically uses one hand to hold and maintain the infant in a desired position while the other hand is attempting to dispense a baby wipe to clean the infant.

However, the dispensing of wipes from such conventional containers for wipes has not been completely satisfactory. For example, this is due at least in part to the configuration of the stack of wipes within the container. In particular, for example, this concerns the relationship of each wipe in the stack to each adjacent wipe in the stack. As another example, this can concern the relationship of a group of wipes in the stack to other wipes in the stack if groups of wipes make up the stack of wipes. As yet another example, these relationships between wipes concern, in conjunction with the wipes, the container from which the wipes are dispensed and characteristics thereof.

SUMMARY OF THE INVENTION

In response to the difficulties and problems discussed above, for example, a new relationship between two adjacent wipes enabling improved dispensing, and which may be more cost effective and reliable (e.g., reducing the likelihood of wipe fallback and/or reducing the likelihood of multiple wipes dispensing undesirably), has been discovered. For example, dispensing can be improved or made easier when a wipe is ready for dispensing upon the opening of a resealable wipes dispenser after the initial opening of the dispenser and use of a first wipe in a plurality of wipes. That is, a portion of the wipe is positioned in an orifice of the dispenser sufficiently protruding so a user can readily grasp the same and remove the entire individual wipe without premature tearing or non-dispensing of the top wipe. As another example wipe fallback can occur when a leading wipe in a plurality of wipes separates completely from a following or trailing wipe prematurely, i.e., before a sufficient portion of the following wipe is positioned within the dispenser orifice to remain there for later dispensing after the leading wipe is fully separated or disjointed from the trailing wipe outside the dispenser. In such a fallback situation, the following wipe would need to be re-threaded through the dispensing orifice when its dispensing is next desired. This may not be undesirable if done intentionally, i.e., if maintaining a maximum moisture level for the wipes is desired and the dispensing orifice is designed to easily accommodate reach-in retrieval of the next wipe. As yet another example multiple wipes dispensing can occur when a leading individual wipe in a plurality of wipes does not timely separate completely from a following individual wipe while the following wipe is still at least partially maintained in the dispensing orifice, i.e., the following wipe dispenses completely out of the dispenser with the leading wipe causing two (or more) wipes to dispense substantially simultaneously. This can be desirable when two (or more) wipes are needed, but if only one is desired, then this is not preferred. The purposes and features of the present invention will be set forth in and are apparent from the description that follows, as well as will be learned by practice of the invention. Additional features of the invention will be realized and attained by the product and processes particularly pointed out in the written description and claims hereof, as well as from the appended drawings.

In one aspect, the invention provides at least two wipes, e.g., a plurality of wipes, separably joined together. Each wipe of the plurality of wipes is moistened with a liquid in an amount of about 25 percent to about 600 percent of a dry weight of the wipe. An adhesive joins together at least two wipes of the plurality of wipes. The adhesive joins the at least two wipes together with an adhesion strength per unit adhesive length greater than 0 g/cm and less than about 200 g/cm. The adhesive can be applied to the at least two wipes before, and alternately after, the wipes are moistened with the liquid.

In another aspect, the invention provides, alternately or in additionally to the adhesion strength per unit length, that the adhesive joins the at least two wipes together with an adhesion strength per unit adhesive area greater than 0 $g/cm^2$ and less than about 1000 $g/cm^2$.

In other aspects, the invention provides various adhesion strengths per unit length and unit area and various adhesive add-on amounts.

In yet other aspects, the invention provides various configurations for the adhesive, the wipes per se, and the wipes relative to other wipes such as in a stack of wipes.

In still other aspects, the invention is provided for use in various types of dispensers and for dispensing in various manners such as reach-in dispensing and pop-up dispensing.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the wipes of the invention. Together with the description, the drawings serve to explain the various aspects of the invention.

BRIEF DESCRIPTION OF THE DRAWINGS

The present invention will be more fully understood and further features will become apparent when reference is made to the following detailed description of the invention and the accompanying drawings. The drawings are merely representative and are not intended to limit the scope of the claims. Like parts depicted in the drawings are referred to by the same reference numerals.

DETAILED DESCRIPTION OF THE INVENTION

Figure 2A:
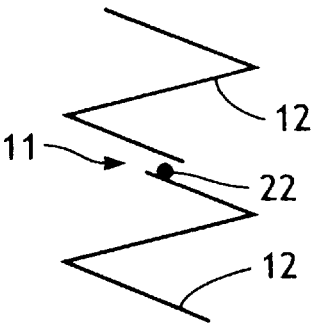
FIG. 2A representatively shows a schematic side view of wipes about to be adhesively joined together, in accordance with the present invention.
Figure 1A:
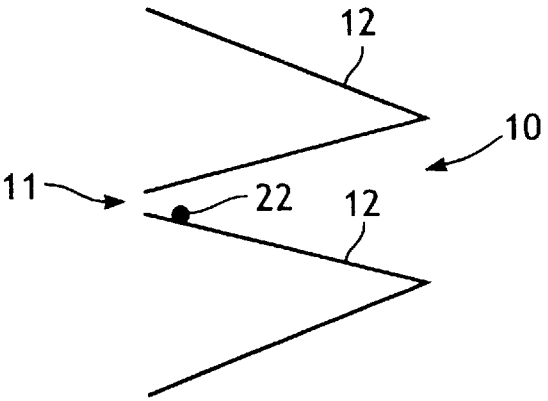
FIG. 1A representatively shows a schematic side view for wipes about to be adhesively joined together, in accordance with the present invention.
Figure 2B:
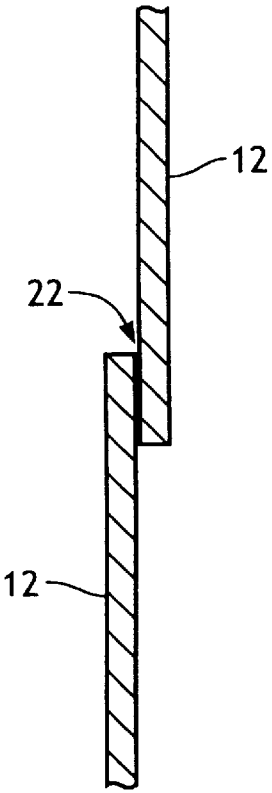
FIG. 2B representatively shows a partial cross sectional expanded side view of the wipes of FIG. 2A, now adhesively joined together and in a position separating one wipe from the other, such as seen in FIG. 3 taken along the line B—B.
Figure 1B:
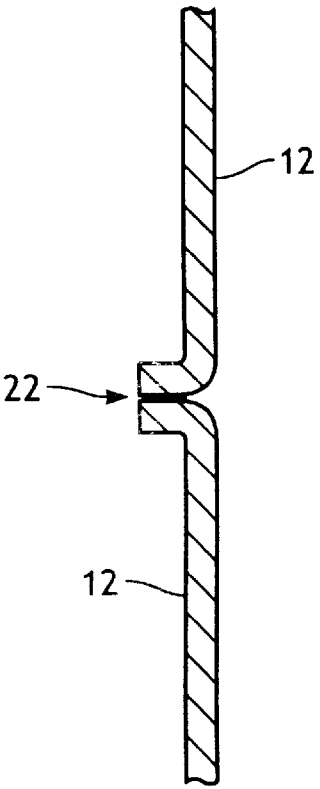
FIG. 1B representatively shows a partial cross sectional expanded side view of the wipes of FIG. 1A, now adhesively joined together and in a position separating one wipe from the other, such as seen in FIG. 3 taken along the line B—B.

As representatively illustrated throughout the figures, and for explanation now referring to FIGS. 1A–2B, inclusive, the present invention provides a plurality 10 of wipes separably joined together, e.g., with an adhesive 22. The circular shape of the symbol for adhesive 22 is not necessarily characteristic of the actual appearance of adhesive applied to the plurality 10, but is merely representative of the existence of such adhesive 22 in combination with the wipes. Also, the location of the adhesive shown at the edge of the wipes is not the only location for adhesive 22. Adhesive 22 could be positioned at other locations across the surface of the wipes between the sides and edges. Also, FIGS. 1A and 2A are merely representative of the configuration for a plurality 10 of wipes which can include at least two wipes 12. For example, the plurality of wipes can include additional wipes, such as a repeating pattern of wipes 12 or different wipes, in a pattern or no pattern, and similar to wipes 12 in FIGS. 1A and 2A or configured differently, with or without adhesive, such as is discussed further below in reference to other Figures.

Wipes of the invention are considered "separably joined together" when each wipe in a plurality, e.g., a stack of wipes, is engaging any adjacent wipe while in the dispenser or package such that withdrawing the leading wipe through the dispenser or package opening also withdraws at least a portion of the following wipe through the opening before the leading wipe and the following wipe separate completely from each other. Such engaging of any adjacent wipe can include a non-interfolded or interfolded relationship in combination with one or more of the following between adjacent wipes: adhesive, friction, cohesion, fusion bonding (e.g., ultrasonic welding, heat sealing), mechanical entanglement (e.g., needle punching, steam sealing, embossing, crimping), autogeneous bonding, and/or forming weakened line(s) (e.g., perforations, zones of frangibility, score line(s)). When the following wipe that has at least a portion through the opening of the dispenser or package is intentionally maintained in the opening after the leading wipe is completely separated from the following wipe, this is referred to herein as "pop-up" format or dispensing. To be intentionally maintained in the opening means the opening is configured to so maintain the wipe therein, such as through use of a constricting opening or opening being smaller than the wipe in at least one dimension of the wipe.

As discussed previously, the dispensing of wipes, and in particular two wipes in succession at different times, presents particular challenges. For example, the inventor's have discovered particular aspects relating to joining at least two wipes together for consistent and reliable dispensing of the first wipe at a first time from a dispenser while maintaining the second wipe at least partially within the dispenser, and then dispensing the second wipe at a later second time from the dispenser awhile after the first wipe has been separated from the second wipe. A couple known ways to address this problem have been attempted through, e.g., various interfolded configurations for wipes (e.g., U.S. Pat. No. 5,497,903 of Yoneyama and art cited therein) or using adhesive between wipes (namely, U.S. Pat. No. 5,520,308 of Berg, Jr. et al.).

As a result of their work, however, the inventors have determined that particular adhesive relationships between the plurality 10 of wipes 12 are better than others for overcoming some challenges to successively dispensing wipes one at a time more successfully. Such can be beneficial to, e.g., easier wipe retrieval, reducing the likelihood of wipe fallback into the container and/or reducing the likelihood of multiple wipes dispensing when only a single wipe is desired, and the balancing/interaction of these features. For example, the inventors have discovered that the adhesive 22 can join together the at least two wipes 12 of the plurality 10 of wipes 12 such that the adhesive joins the at least two wipes together with an adhesion strength per unit adhesive length greater than 0 g/cm and less than about 200 g/cm. More particularly, the inventors have discovered that the adhesion strength per unit length can advantageously be, in order of increasing advantage, less than about 150 g/cm, less than about 100 g/cm, less than about 75 g/cm, less than about 50 g/cm, less than about 25 g/cm, or less than about 15 g/cm. As another example, the inventors have discovered that the adhesive 22 can join together the at least two wipes 12 of the plurality of wipes 10 such that the adhesive joins the at least two wipes together with an adhesion strength per unit adhesive area greater than 0 g/cm$^2$ and less than about 1000 g/cm$^2$. More particularly, the inventors have discovered that the adhesion strength per unit area can advantageously be, in order of increasing advantage, less than about 750 g/cm$^2$, less than about 500 g/cm$^2$, less than about 250 g/cm$^2$, less than about 100 g/cm$^2$, less than about 50 g/cm$^2$, less than about 25 g/cm$^2$, or less than about 10 g/cm$^2$.

Figure 4:
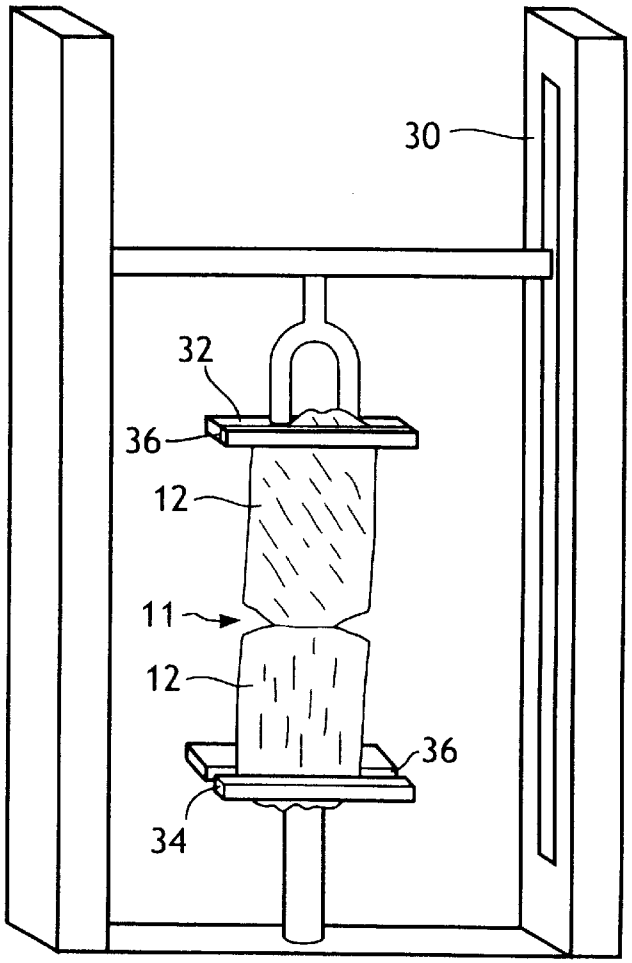
FIG. 4 representatively shows a perspective view of the test machine and wipes of FIG. 3 while the machine is activated and as the wipes become partially disjointed from each other.
Figure 3:
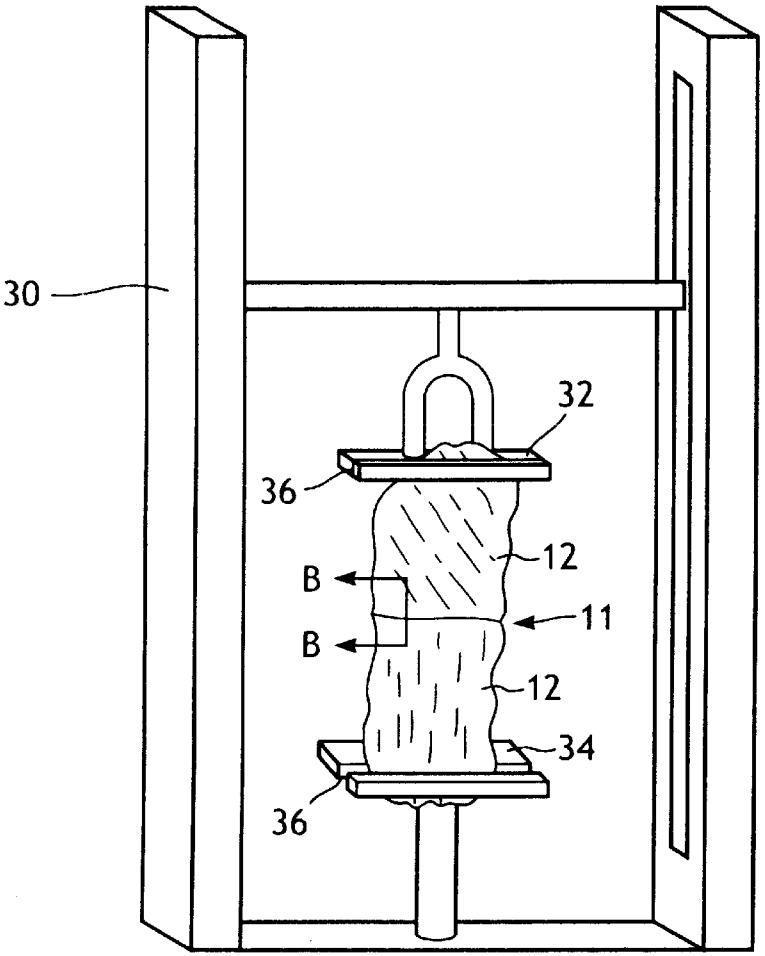
FIG. 3 representatively shows a perspective view of a test machine with the two wipes of FIGS. 1A or 2A positioned therein before the machine is activated.

In reference to FIGS. 3 and 4, the test for measuring the adhesion strength between two wipes is now explained. The testing is done, generally, under TAPPI standard procedures and conditions which would be applicable except as otherwise noted.

A SINTECH™ Model #M4001 with a MTS 25 pound (11.4 Kg) load cell conventional test machine 30 equipped with TestWorks™ 3.10 software for Windows, or comparable equipment, is used. Both the Sintech™ test machine 30 and TestWorks™ software are available from MTS Corporation located at 1400 Technology Drive, Eden Prairie, Minn., USA. The measurement procedure begins by providing two adhesively joined wipes, e.g., carefully removing two adhesively joined wipes from a stack of wipes without materially disrupting the adhesive joint between the two wipes. Next, the distance between two jaws 32, 34 of machine 30 are set about two inches (5 cm) shorter than the end to end distance (i.e., perpendicular to the adhesive joint 11) from the end of the upper wipe secured in upper jaw 32 to the end of the lower wipe secured in lower jaw 34. Grip area 36 of each jaw is about 4.5 inches by 0.5 inches (11.25 cm by 1.25 cm). The non-adhesively joined center end portion (about 4 inches by 1 inch (10 cm by 2.5 cm)) of one wipe is clamped to upper jaw 32 while the non-adhesively joined center end portion (about 4 inches by 1 inch (10 cm by 2.5 cm)) of the adjoining wipe is clamped to lower jaw 34. Machine 30 is activated to move the jaws away from each other, e.g., one or both jaws w moving relative to the machine, at a speed of about one-hundred (100) cm/min until the adhesive joint 11 completely breaks and the two once adhesively joined wipes are completely disjointed from each other. The disjointing of the two wipes may occur as seen in FIG. 4, e.g., from the outside edges in, but could also occur from the inside out, from one side to the other or at one or more points between the sides. The actual tear propagation pattern is not critical, but rather, determining the peak load during testing is the goal. The force in grams (g) as a function of the distance of the jaws movement relative to the machine is recorded using the TestWorks™ 3.10 software. The peak load exhibited during the test is designated as the adhesion strength, in grams of force (g), between two adhesively joined wipes. The adhesion strength per unit length or area, respectively, is the adhesion strength divided by the adhesive length or area, respectively, as determined here below.

Figure 5B:
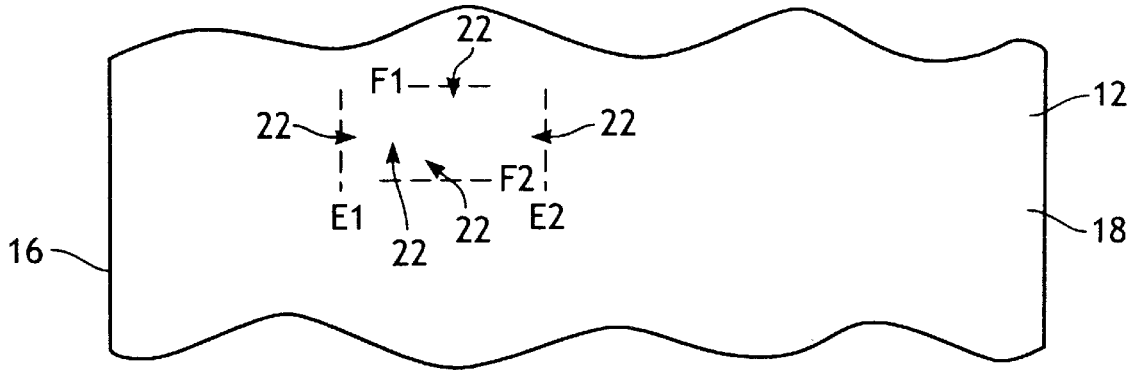
FIGS. 5A and 5B representatively show a top surface view of a portion of a wipe similar to that in FIG. 5, but with a different adhesive pattern applied thereto.
Figure 5A:
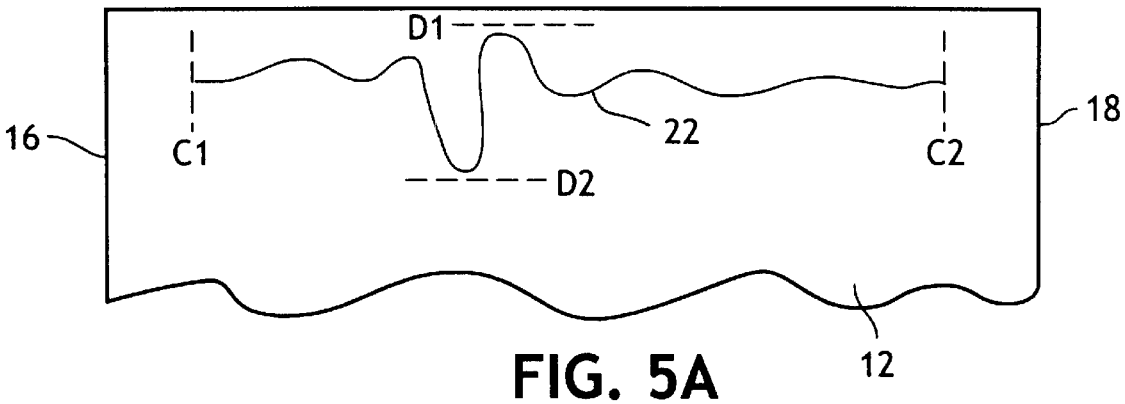
Figure 5:
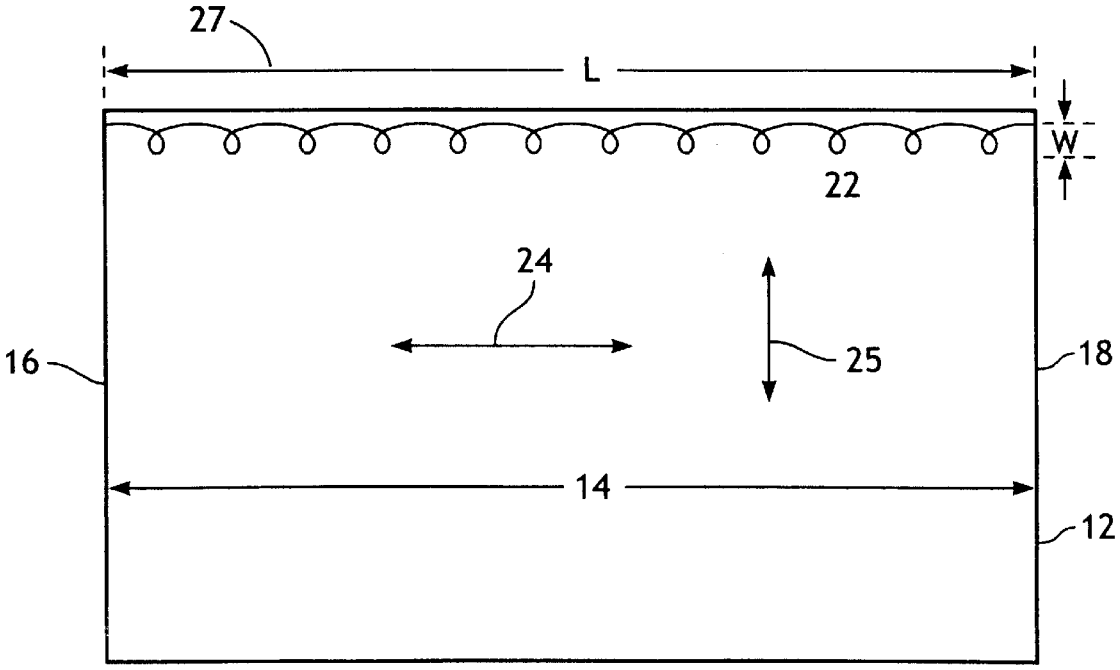
FIG. 5 representatively shows a top view of a top surface portion of a wipe with adhesive applied thereto, in accordance with the present invention.

To determine the adhesive length or area, the following measurement(s) are made, in reference to FIGS. 5 to 5B, inclusive. The area where the adhesive is applied can be identified by various techniques known to those having ordinary skill in the art. For example without limitation, such could include Osmium Tetroxide testing. Reaction with osmium tetroxide is a common technique in microbiological analysis[1] and polymer investigations[2]. In biological materials, the osmium tetroxide reacts with the unsaturated carbon in the lipids of cells and fatty acids. In polymer materials, osmium tetroxide is used either to react with unsaturated carbon, as is common in natural rubbers or to lend contrast by preferentially absorbing into differing polymers. In both cases, the purpose is to lend contrast for both optical and electron microscopy. Many adhesives respond favorably to osmium tetroxide vapors by blackening relative to less reactive surroundings. Consequently, they are rendered visible for either a qualitative examination or quantitation by image analysis methods. If osmium tetroxide is not effacacious with the material, the microscopist can experiment with a variety of conventional liquid or vapor stains to generate the desired contrast. Also, it is intended that the adhesive dimensions being determined, although the adhesive is joining together two wipes, are defined in relation to the top surface (e.g., two-dimensional surface) of one wipe for that portion of the adhesive which acts to join the two wipes together. That is, the adhesive dimensions relevant to the invention are those of a hypothetical two-dimensional adhesive layer between the two wipes and not the combined individual surface area of the opposing sides of the adhesive that joins each opposing top surface of the two wipes. As such, determining the dimensions of the adhesive of the invention relative to the top surface of one wipe is what is necessary to define the adhesive length and adhesive area of the invention. Toward this end, first, an imaginary box is drawn around the applied adhesive, so as to completely circumscribe all adhesive applied to the wipes for the purpose of separably joining one wipe to another wipe as discussed herein. This includes any type of applied adhesive from that in discrete locations to that in not so discrete locations such as a spray of adhesive. In reference to FIG. 5, the length L, which defines the "adhesive length," is determined by measuring the distance from one end of the box to the other end along the direction 24 that is also generally parallel to the dimension of the wipe that is joined to a preceding or succeeding wipe. In FIG. 5 this is the side to side width 14 of the wipe in the direction 24. The width W of the applied adhesive, which defines the adhesive width, is determined by measuring the distance from one end of the box to the other end along the direction 25 which is also generally perpendicular to the dimension of the wipe that is joined to a preceding or succeeding wipe. Then, to determine the "adhesive area" called A, the adhesive length L is multiplied by the adhesive width W. Thus, to determine the adhesion strength per unit adhesive length the adhesion strength, as determined above, is divided by the length L, as determine above. And, to determine the adhesion strength per unit adhesive area, the adhesion strength, as determine above, is divided by the area A, as determine above.

[1] F. L. Carlson, *Histotechnology, A Self-Instructional Text*, ASCP Press, Chicago, 1990). Page 16.

[2] L. C. Sawyer and D. T. Grubb, *Polymer Microscopy*, 2 ed. (Chapmand & Hall, New York, 1996). Page 103.

FIG. 5A demonstrates an alternate applied adhesive configuration and the way to measure the adhesive length, width and thus area. The length L, which defines the "adhesive length," is determined by measuring the distance from one end C1 of the box to the other end C2 along the direction that is generally parallel to the dimension of the wipe that is joined to a preceding or succeeding wipe. The width W of the applied adhesive, which defines the adhesive width, is determined by measuring the distance from one end D1 of the box to the other end D2 along the direction which is generally perpendicular to the dimension of the wipe that is joined to a preceding or succeeding wipe. Then, to determine the "adhesive area" called A, the adhesive length L is multiplied by the adhesive width W. Adhesion strength per unit adhesive length or area is determined as for FIG. 5.

FIG. 5B demonstrates yet an alternate applied adhesive configuration, and here located substantially in from the end of the wipe, and the way to measure the adhesive length, width and thus area. The length L, which defines the "adhesive length," is determined by measuring the distance from one end E1 of the box to the other end E2 along the direction that is generally parallel to the dimension of the wipe that is joined to a preceding or succeeding wipe. The width W of the applied adhesive, which defines the adhesive width, is determined by measuring the distance from one end F1 of the box to the other end F2 along the direction which is generally perpendicular to the dimension of the wipe that is joined to a preceding or succeeding wipe. Then, to determine the "adhesive area" called A, the adhesive length L is multiplied by the adhesive width W. Adhesion strength per unit adhesive length or area is determined as for FIG. 5.

ITW Dynatec 16-foot long transport hose, part #101088D, with electrical connections modified to fit the Nordson electric gun, supplied the melted adhesive from the melt bank to the electric gun. The adhesive was applied in a swirl pattern and at a location similar to that seen in FIG. 5. To prepare the sample, the adhesive was applied to the top surface of the first wipe moving at a speed of about 320 ft/minute. The adhesive was maintained at about 375 degrees Fahrenheit and system pressures were adjusted to obtain the desired add-on through the nozzle. At this speed, the required system pressure ranged from about 55 psi to obtain 0.00060 grams/wipe to about 140 psi to obtain 0.0040 grams/wipe. Then, the second wipe was laid on top of the first wipe with adhesive thereon within about 3–4 seconds. About 2 seconds later, a pressure about ⅓ psi was uniformly applied on top of the second wipe for fractions of a second to a few seconds. This pressure could vary from 0 (i.e., the weight of the wipe itself) to 2 psi (i.e., by the use of an additional force), as well as possible other pressures. The wipes with adhesive applied thereon were placed in a sealed container, such as a plastic bag and allowed to rest for 2 to 6 days. The sealed container of wipes was then placed in a test lab and allowed to equilibrate to room temperature of about 20 degrees Celsius for about 24 hours, remaining sealed in the container until testing. The samples were then measured for adhesion strength between the two wipes in the manner explained above in reference to FIGS. 3 and 4.

TABLE 1

| | Adhesive Type | Adhesive Length (L) (cm) | Adhesive Width (W) (cm) | Adhesive Area (A) ($cm^2$) | Adhesion (g/wipe) | Adhesion Strength per unit Length (g/cm) | Adhesion Strength per unit Adhesion Area ($g/cm^2$) | Adhesive Add-on (g/wipe) | Adhesive Add-on per unit Adhesive Area ($g/cm^2$) |
|---|---|---|---|---|---|---|---|---|---|
| Sample A | RT273 0APAO | 18.75 | 1.25 | 23.4 | 179 | 9.5 | 7.6 | .00060 | $2.6 \times 10^{-5}$ |
| Sample B | RT273 0APAO | 18.75 | 1.25 | 23.4 | 245 | 13.1 | 10.5 | .0010 | $4.3 \times 10^{-5}$ |
| Sample C | RT273 0APAO | 18.75 | 1.25 | 23.4 | 310 | 16.5 | 13.2 | .0020 | $8.5 \times 10^{-5}$ |
| Sample D | RT273 0APAO | 18.75 | 1.25 | 23.4 | 355 | 18.9 | 15.2 | .0025 | $1.1 \times 10^{-4}$ |
| Sample E | RT273 0APAO | 18.75 | 1.25 | 23.4 | 480 | 25.6 | 20.5 | .0040 | $1.7 \times 10^{-4}$ |

Table 1 sets out data obtained from samples made in accordance with the teachings of the invention. Samples A through E were all made from a basesheet of coform comprising the same material known as the baby wipes product currently available from Kimberly-Clark Corporation of Neenah, Wis. under the tradename HUGGIES® Natural Care and moistened with 330% add-on of HUGGIES® Natural Care solution. Samples A through E also used the same hot melt adhesive, commonly known as RT 2730 APAO sold by Huntsman Polymers Corporation of 2502 South Grandview, Odessa, Tex. 79766. The adhesive was applied to the moistened coform with a prototype model ES400 electric gun, manufactured by Nordson Corp. of 2905 Pacific Drive, Norcross, Ga. The gun was fifted with a high frequency swirl nozzle, part #757537-0.012 spc. with a 0.012 inch orifice, spraying a continuous pattern approximately 18 mm away from the moistened basesheet. The adhesive was provided from a Dynamelt™ melt tank and pump system, model #SIG6ZFD2-F, manufactured by ITW Dynatec of 31 Volunteer Drive, Hendersonville, Tenn. An Table 2 sets out data obtained from two samples provided by another prior to applicants' date of invention for the subject matter disclosed herein. As such, applicants know limited information about these samples and set forth all they know. Comparative samples 1 and 2 were made under similar conditions, although it is not known what equipment was used to apply adhesive to the wipes. The adhesive used was known as product number HL-8151-X ZP, sold by H. B. Fuller Company of 1200 Willow Lake Blvd., P.O. Box 64683, St. Paul, Minn. 55164. For comparative sample 1, a single dot of adhesive was applied to a moistened wipe having the measurements noted in the Table and a second moistened wipe then placed on top to join the two wipes. The moistened material was made of an airlaid basesheet with a liquid add-on of at least 200 percent of a dry weight of the wipes. The basesheet of comparative sample 1 is believed to be that known by the basesheet material tradename AIRTEX™ 8719 sold in the United States by the former Fort James Corporation. The basesheet of comparative sample 1 is believed to have been moistened with a liquid including water, potassium sorbate, tartaric acid, aloe vera, glycerin, natural powder scent, and sodium hydroxide, at an add-on rate described above. The basesheet of comparative sample 2 is believed to be that known by the baby wipes tradename PAMPERS® sold in Europe by the Proctor & Gamble Company. Comparative sample 2 (made of a spunlace basesheet material) was also moistened before adhesive in a single dot having the measurements noted in the Table was applied, and a second moistened wipe placed on top to join the two wipes together. The adhesive add-on rate was about 0.008 to 0.03 grams for both comparative samples. The comparative samples were tested similar to that for samples A to E in Table 1.

TABLE 2

| | Adhesive Type | Adhesive Length (L) (cm) | Adhesive Width (W) (cm) | Adhesive Area (A) ($cm^2$) | Adhesion (g/wipe) | Adhesion Strength per unit Length (g/cm) | Adhesion Strength per unit Adhesion Area ($g/cm^2$) | Adhesive Add-on (g/wipe) | Adhesive Add-on per unit Adhesive Area ($g/cm^2$) |
|---|---|---|---|---|---|---|---|---|---|
| Comparative Sample 1 | HL8151-X ZP | .93 | .2 | .19 | 190 | 204 | 1000 | .008 to .03 | .042 to .158 |
| Comparative Sample 2 | HL8151-X ZP | .31 | .31 | .10 | 450 | 1452 | 4500 | .008 to .03 | .08 to .3 |

In reference to FIG. 5, the inventors have discovered other aspects that can be employed, as desired, to favorably impact the adhesive relationship between wipes 12. For example, adhesive 22 can be a substantially continuous strip of adhesive, and even, extending from about a first side 16 of the wipes to about a second side 18 of the wipes 12. As another example, adhesive 22 can be applied, at least in part, in a curved pattern. Yet further, for example, the adhesive can be applied, at least in part, in a swirl pattern. Still further, for example, adhesive 22 can join the wipes 12 together over an adhesive length equal to or greater than about 7 percent of a width 14 of the wipes, and advantageously equal to or greater than about 25 percent of width 14. Generally, the width 14 is defined as the dimension of the wipe that is generally parallel to the dimension of the wipe that is joined to a preceding or succeeding wipe. As such, the width of the wipes is determined by first drawing outer imaginary lines along the outer most edges of sides 16 and 18, respectively, parallel to the direction 25. Next, a connecting imaginary line in the direction 24 perpendicular to 25 is drawn connecting the outer imaginary lines. The width 14 is determined as the distance along the connecting imaginary line between the outer imaginary lines. In FIG. 5, this turns out to be a straight forward task. However, if the outer edges of sides 16, 18 are non-linear, then the above determination can prove useful.

The inventors have discovered still another aspect that can be employed, as desired, to favorably impact the adhesive relationship between wipes 12, and in a cost effective manner as desired. For example, in combination with some or all of the adhesion strength characteristics discussed previously, adhesive 22 can be added-on to the wipes 12 in an amount per unit adhesive area greater than 0 $g/cm^2$ and less than about 0.04 $g/cm^2$. Here grams (g) represent grams mass, as opposed to grams force for the adhesion strength features. More particularly, the inventors have discovered that the add-on amount per unit adhesive area can advantageously be, in order of increasing advantage, less than about 0.001 $g/cm^2$, less than about 0.0001 $g/cm^2$, or less than about 0.00003 $g/cm^2$. In this regard, the inventors have discovered that it is the surface length, width, and area of the adhesive (i.e., opposing surfaces of the adhesive which engage the adjacent surface of each wipe 12 being joined by the adhesive) that has a greater impact on the adhesion strength characteristic than does the quantity of adhesive, such as a thickness dimension of the applied adhesive, as long as a minimum amount of adhesive is present to sufficiently engage the surfaces of the wipes.

The inventors have discovered still another aspect that can be employed, as desired, to favorably impact the adhesive relationship between a plurality 10 of wipes 12. For example, in combination with some or all of the adhesive characteristics discussed previously, adhesive 22 can be added-on to the wipes 12 anywhere across the top surface portion of the wipe that will directly oppose the adjacent wipe laid on top for adhesive joining thereto (e.g., anywhere across the top surface portion seen in FIG. 5). More particularly, the inventors have discovered that the add-on location across the top surface portion of the wipes can advantageously be located relative to the leading edge 27, in order of increasing advantage, within 75% of the leading edge, within 50% of the leading edge, within 25% of the leading edge, or within 10% of the leading edge.

The plurality 10 of wipes 12 of the present invention, e.g., wet wipes, can be arranged in a package or dispenser in any manner which provides convenient and reliable one at a time dispensing and which assists the wet wipes in not becoming overly dry. For example, the wet wipes can be arranged in a dispenser or package as a plurality of individual sheets arranged in a stacked configuration to provide a stack of wet wipes which may or may not be individually folded. The wet wipes can be individual wet wipes which are folded in a c-fold, z-fold configuration or other non-interfolded configuration as are known to those skilled in the art. Alternatively, the individual wet wipes can be interfolded such that the leading and trailing end edges of successive wipes in the stacked configuration overlap. In each of these non-interfolded and interfolded configurations, the leading end edge of the following wet wipe is loosened from the stack by the trailing end edge of the leading wet wipe as the leading wet wipe is removed by the user from the dispenser or package.

Figure 6B:
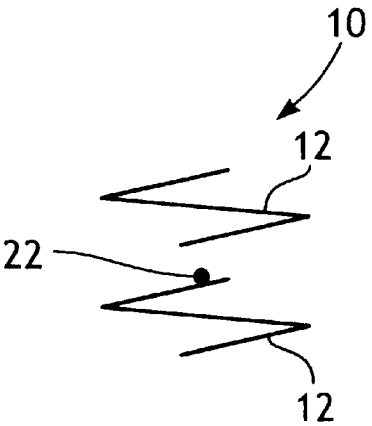
FIGS. 6A and 6B representatively show schematic side views of non-interfolded wipes, in accordance with the present invention.
Figure 6A:
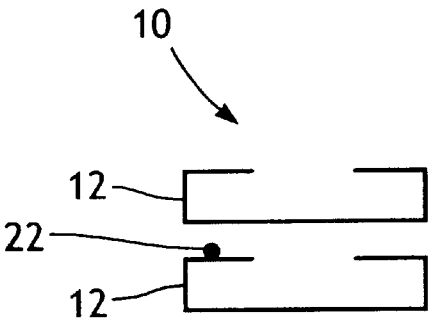

FIGS. 6A and 6B schematically show additional configurations for wipes 12 of the invention. The wipe stack includes a plurality of individual wet wipes 12 stacked one on top of each other in a non-interfolded configuration. For such a "non-interfolded" wipe, each wipe is folded onto itself with no portion of another wipe being positioned underneath any portion of the adjacent wipe(s). These configurations for wipes, as well as those discussed above, can be provided by means known to those skilled in the art.

Figure 7B:
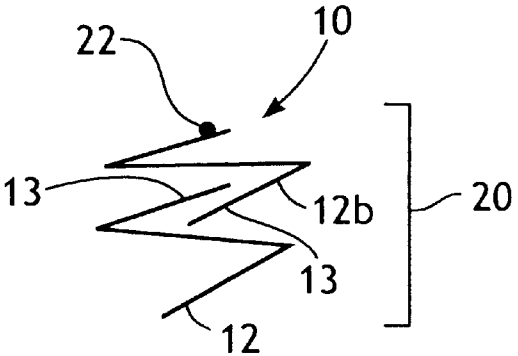
FIGS. 7A and 7B representatively show schematic side views of interfolded wipes, in accordance with the present invention.
Figure 7A:
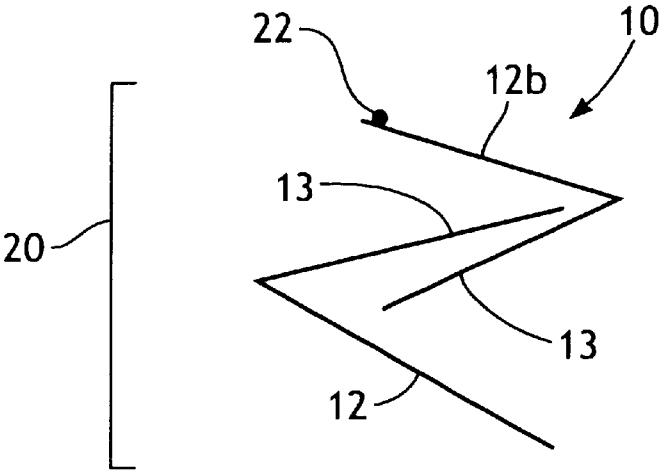

FIGS. 7A and 7B schematically show still additional configurations for wipes 12 of the invention. The wipe "clips" 20 include a plurality of individual wet wipes 12, which are stacked one on top of each other in an interfolded configuration, with the top wipe of the clip having adhesive 22 for joining to another wipe or clip of wipes. For such an "interfolded" wipe clip, at least two wipes in the clip of wipes include a portion 13 positioned underneath a portion of an adjacent wipe. Particular fold configurations the same or similar to those here can be provided by means known to those skilled in the art.

Figure 8:
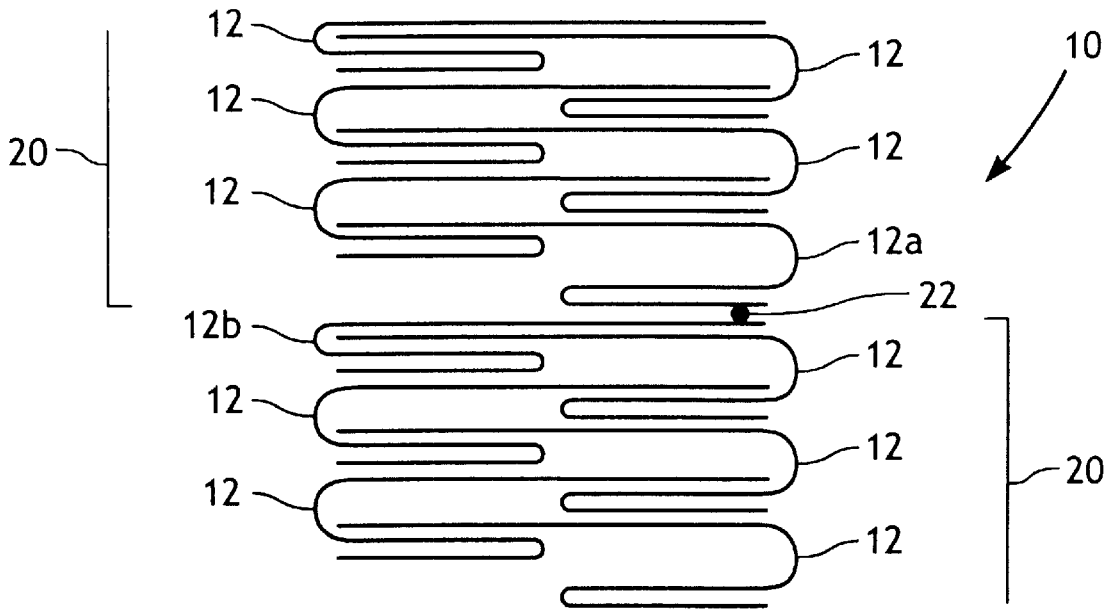
FIGS. 8 and 9 representatively show schematic side views of a stack of wipes, in accordance with the present invention.
Figure 9:
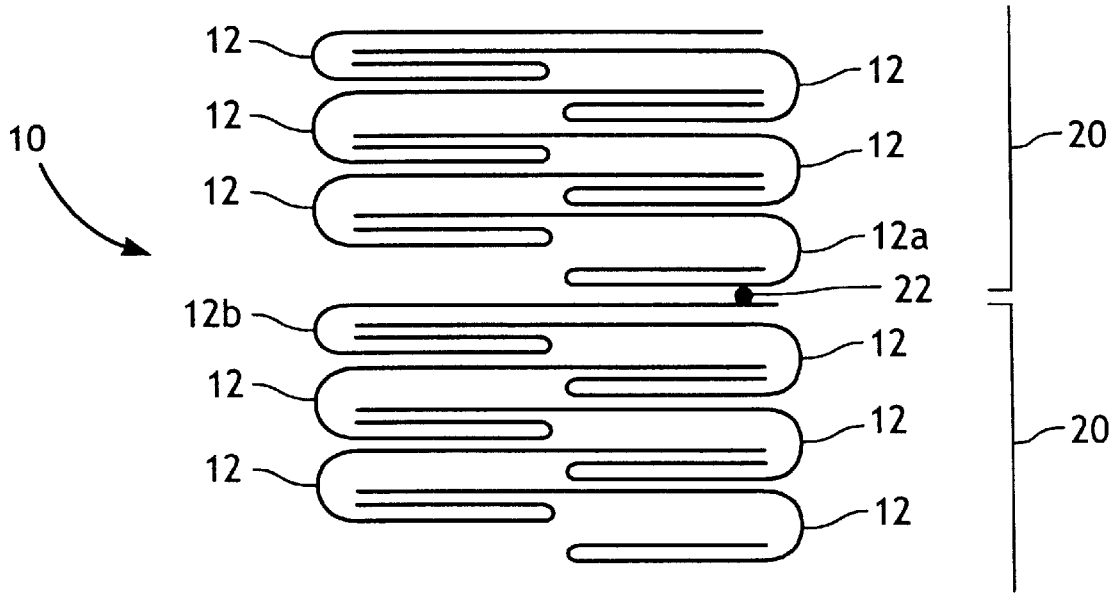

FIGS. 8 and 9 show another example of interfolded configurations for wipes in accordance with the invention, and are set forth in U.S. Pat. No. 5,497,903, issued Mar. 12, 1996, of inventor Katsu Yoneyama, the disclosure of which is incorporated herein by reference. Here, the wipes 10 are a stack of wipes 12 including at least two clips 20 of separably joined wipes 12. Additional clips 20 of wipes 12 could be included in a stack, as desired, and the clip could include any where from 2 wipes up to 24 wipes, and from 4 to 18 wipes and about 8 wipes. A last wipe 12*a* of one clip 20 is adhesively joined to a first wipe 12*b* of a succeeding clip 20. Otherwise, the remainder of wipes in the clips 20, are separably joined together without use of the adhesive, i.e., and instead through the use of an interfolded configuration.

Figure 10A:
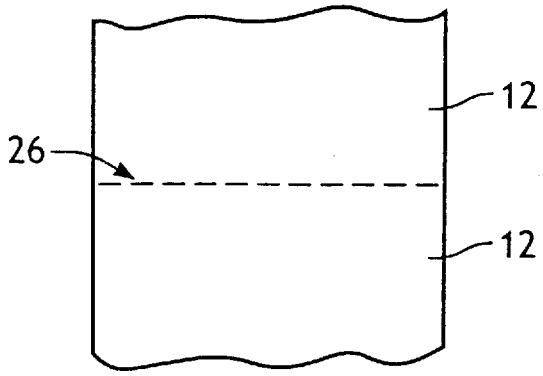
FIGS. 10A and 11A representatively show schematic top views of a portion of the wipes of FIGS. 10 and 11, respectively.
Figure 11A:
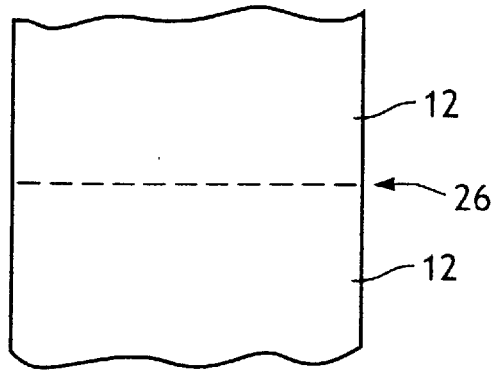
Figure 10:
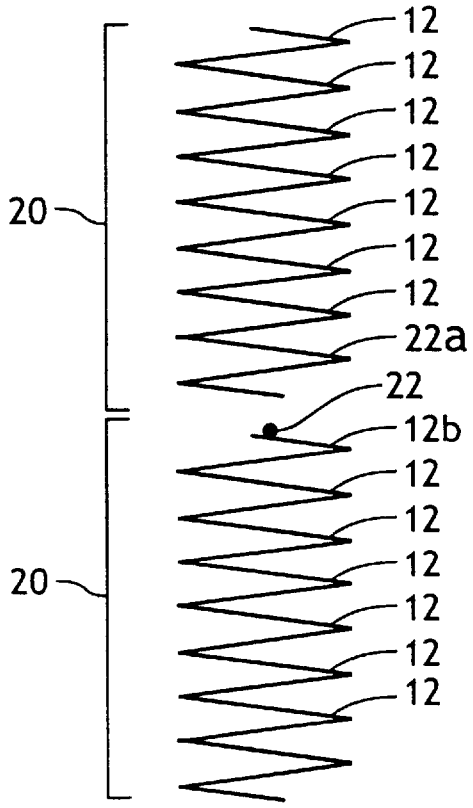
FIGS. 10, 10B, 10C and 11 representatively show schematic side views of clips of wipes, in accordance with the present invention.
Figure 11:
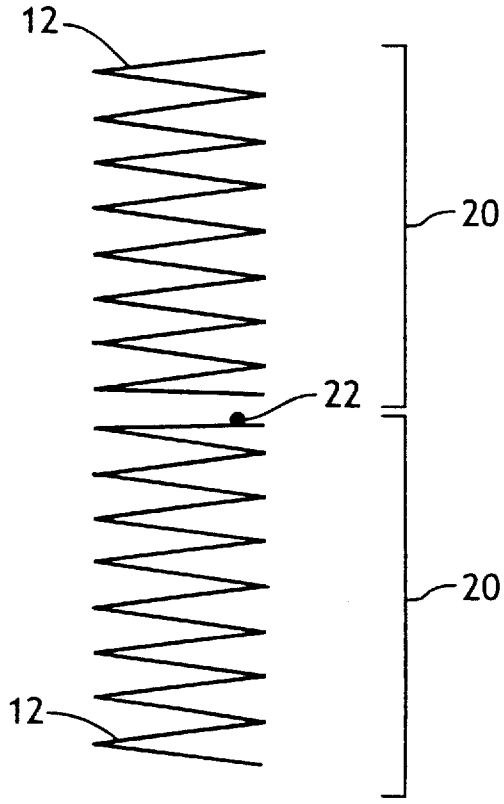
Figure 10C:
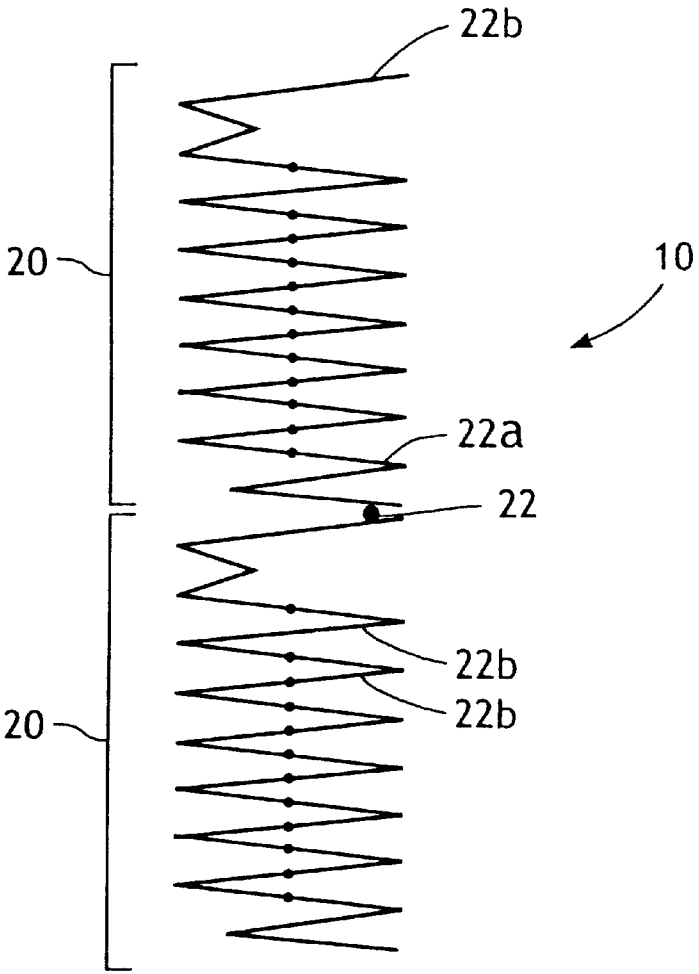
Figure 10B:
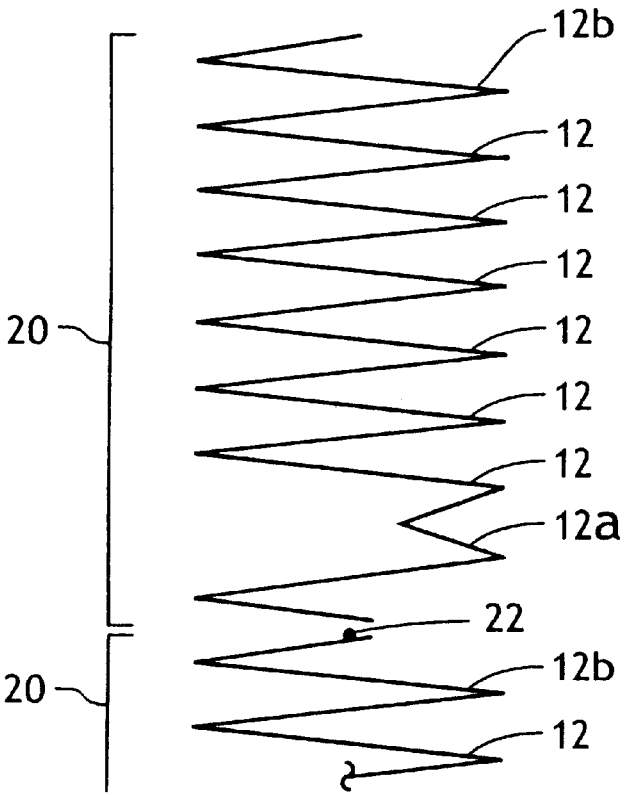

Alternatively, the wipes 12 can be arranged in a plurality 10 of wipes 12 as a continuous web of weakened line connected wet wipes which are folded in an accordion-like stacked configuration, as seen in FIGS. 10, 10B, 11C and 11. The wipes 12 in FIG. 11 are also a plurality of individual wipes like those in FIG. 10, although each wipe is not separately numbered as in FIG. 10. In this regard, the making of each such clip 20 of wipes 12 is disclosed in a US patent application filed separately but concurrently herewith entitled, "STACK OF FAN FOLDED MATERIAL AND COMBINATIONS THEREOF" of inventor Gerald K. Sosalla, U.S. Ser. No. 10/161,166, assigned to the same assignee of this application and known by attorney docket number 16214A, which application is incorporate fully herein by reference. Also referring to FIGS. 10A and 11A, a top view of a portion of the wipes in the clips in an unfolded state shows the individual wet wipes of the clips can be separably joined together along lines of frangibility 26, such as lines of perforations, to ensure that the trailing wet wipe is in position for grasping by the user after the leading wet wipe is removed. For example, the wet wipes can be provided by a continuous web of material which has a series of lines of frangibility extending across the width of the web. The portion of the web of material between successive lines of frangibility provides each individual wet wipe. Additionally, the lines of frangibility can be provided by means known to those skilled in the art such as perforations, indentations or cuts in the web of material. After the lines of frangibility have been incorporated into the web of material, the web can then be arranged in a stacked configuration for easy insertion into a dispenser or package.

Referring generally to the figures now, the plurality of wipes, such as a stack of wipes 12, can include any suitable number of individual wet wipes depending upon the desired packaging and end use. For example, the plurality 10 can be configured to include a stack of wet wipes which can include at least about 5 wet wipes and desirably from about 16 to about 320 individual wet wipes, and more desirably from about 32 to about 160 wet wipes. The size and shape of the stack of wipes 12 is dependent upon the size and shape of the package/dispenser and vice versa. For example, the length of an assembled stack of wipes can be about 190 mm, with a height of about 90 mm and a width of about 100 mm.

Each wet wipe is generally rectangular in shape and defines a pair of opposite side edges and a pair of opposite end edges which can be referred to as a leading end edge and a trailing end edge. The leading end edge of each wet wipe is typically positioned in the package/dispenser to be grasped by a user to facilitate a removal of the wet wipe from the package/dispenser. Each wet wipe defines an unfolded width and an unfolded length. The wet wipe can have any suitable unfolded width and length. For example, the wet wipe can have an unfolded length of from about 2.0 to about 80.0 centimeters and desirably from about 10.0 to about 26.0 centimeters and an unfolded width of from about 2.0 to about 80.0 centimeters and desirably from about 10.0 to about 45.0 centimeters. In reference to FIG. 5, the width of a wipe is defined along dimension 24 and the length of a wipe along dimension 25.

Materials suitable for the wet wipes of the present invention are well known to those skilled in the art. The wet wipes can be made from any material suitable for use as a wipe, including meltblown, coform, airlaid, bonded-carded web materials, spunlace, hydroentangled materials, high wet-strength tissue and the like and can comprise synthetic or natural fibers or combinations thereof. The wet wipes can have a dry basis weight of from about 25 to about 120 grams per square meter and desirably from about 40 to about 90 grams per square meter.

In a particular aspect, the wet wipes can comprise a coform basesheet of polymeric microfibers and cellulosic fibers having a basis weight of from about 60 to about 100 grams per square meter and desirably about 80–85 grams per square meter. Such coform basesheets are manufactured generally as described in U.S. Pat. No. 4,100,324 to Anderson et al. which issued Jul. 11, 1978, and which is herein incorporated by reference. More particularly, such coform basesheets can be manufactured as are described as part of recently filed U.S. patent application Ser. No. 09/751,329, filed on Dec. 29, 2000 entitled, "Composite Material With Cloth-like Feel" of inventors Scott R. Lange et al., and which is incorporated herein by reference. Typically, such coform basesheets comprise a gas-formed matrix of thermoplastic polymeric meltblown microfibers, such as, for example, polypropylene microfibers, and cellulosic fibers, such as, for example, wood pulp fibers. The relative percentages of the polymeric microfibers and cellulosic fibers in the coform basesheet can vary over a wide range depending on the desired characteristics of the wet wipes. For example, the coform basesheet can comprise from about 20 to about 100 weight percent, desirably from about 20 to about 60 weight percent, and more desirably from about 30 to about 40 weight percent of polymeric microfibers based on the dry weight of the coform basesheet being used to provide the wet wipes. An example of such a coform basesheet for use in the present invention is found in the baby wipes product presently sold by Kimberly-Clark Corporation and known as HUGGIES® Natural Care.

In another aspect of the invention, wipes 12 can contain a liquid which can be any liquid or solution which can be absorbed into the wipes (e.g., water based, oil based, others), thus making them wet wipes. The wipes can be moistened at any time before the wipes are actually used by the consumer. Preferably they are moistened some time during the manufacturing process before or contemporaneous with the plurality of wipes being sealed in a dispenser or other packaging for next use by a product user. The liquid contained within the wet wipes can include any suitable components which provide the desired wiping properties. For example, the components can include water, emollients, surfactants, preservatives, chelating agents, pH buffers, fragrances or combinations thereof. The liquid can also contain lotions, ointments and/or medicaments. An example of such a liquid for use in the present invention is found in the baby wipes product presently sold by Kimberly-Clark Corporation and known as HUGGIES® Natural Care.

The amount of liquid or solution contained within each wet wipe can vary depending upon the type of material being used to provide the wet wipe, the type of liquid or solution being used, the type of container being used to store the stack of wet wipes, and the desired end use of the wet wipe. Generally, each wet wipe can contain from about 25 to about 600 weight percent and desirably from about 200 to about 400 weight percent liquid based on the dry weight of the wipe, for improved wiping in certain instances. To determine the liquid add-on, first the weight of a just-manufactured dry wipe is determined. Then, the amount of liquid by weight equal to a multiple (e.g. 1, 1.5, 2.5, 3.3, etc., times) whereas 1=100%, 2.5=250%, etc., of the just-manufactured dry wipe, or an increased amount of liquid measured as a percent add-on based on the weight of the just-manufactured dry wipe, is added to the wipe to make it moistened, and then known as a "wet wipe". In a particular aspect wherein the wet wipe is made from a coform material comprising from about 30 to about 40 weight percent polymeric microfibers based on the dry weight of the wipe, the amount of liquid contained within the wet wipe is from about 250 to about 350 weight percent and desirably about 330 weight percent based on the dry weight of the wet wipe. If the amount of liquid is less than the above-identified range, the wet wipes can be too dry and may not adequately perform depending on the desired task. If the amount of liquid is greater than the above-identified range, the wet wipes can be over saturated and soggy and the liquid can pool in the bottom of the container, as well as possibly contribute to problems with the adhesive 22 sticking to the surface of wipes 12.

Figure 12:
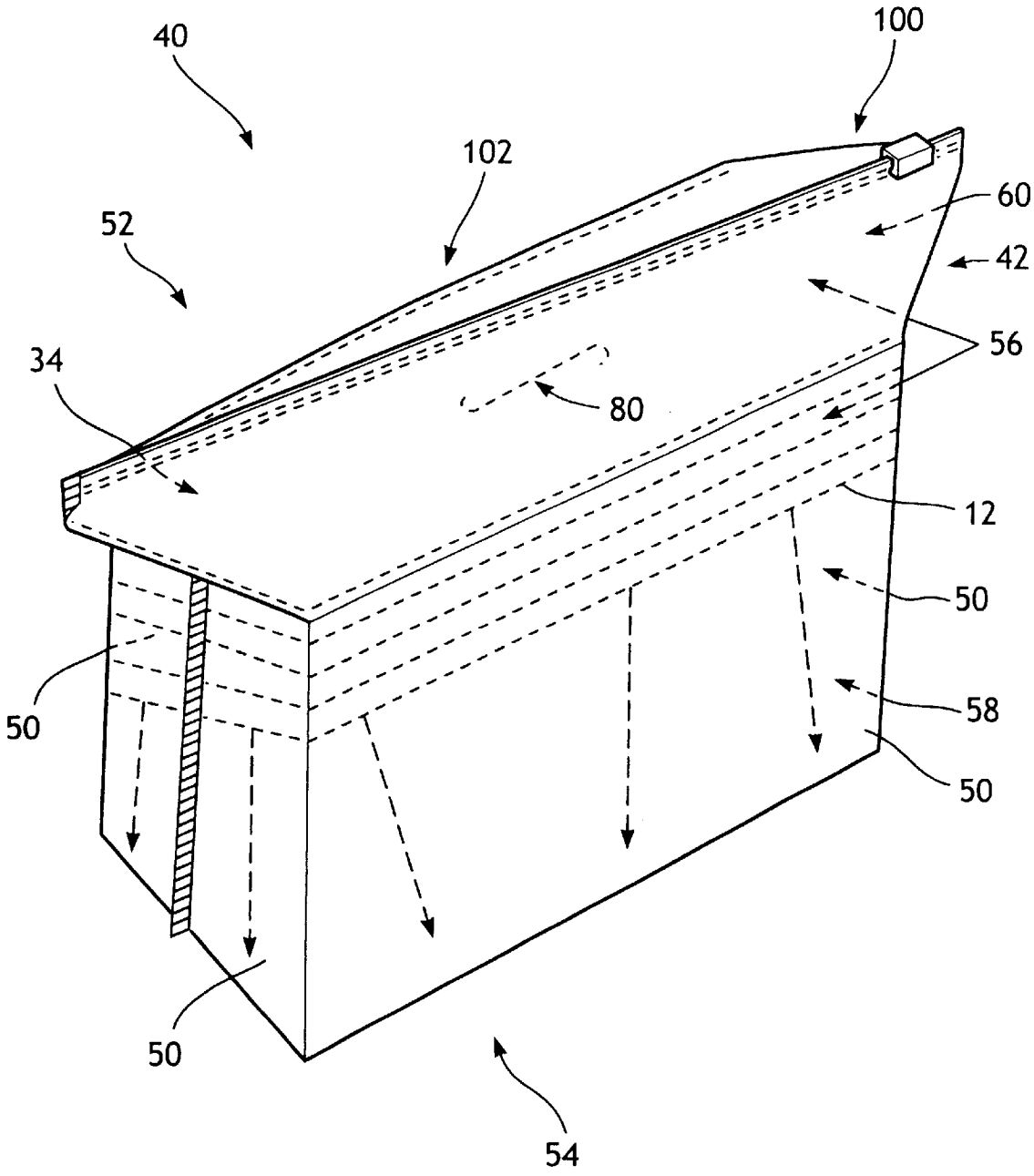
FIG. 12 representatively shows a perspective view of a type of non-rigid dispenser for use with wipes of the present invention, where wipes are sealed therein and the dispenser is sealed closed.
Figure 13:
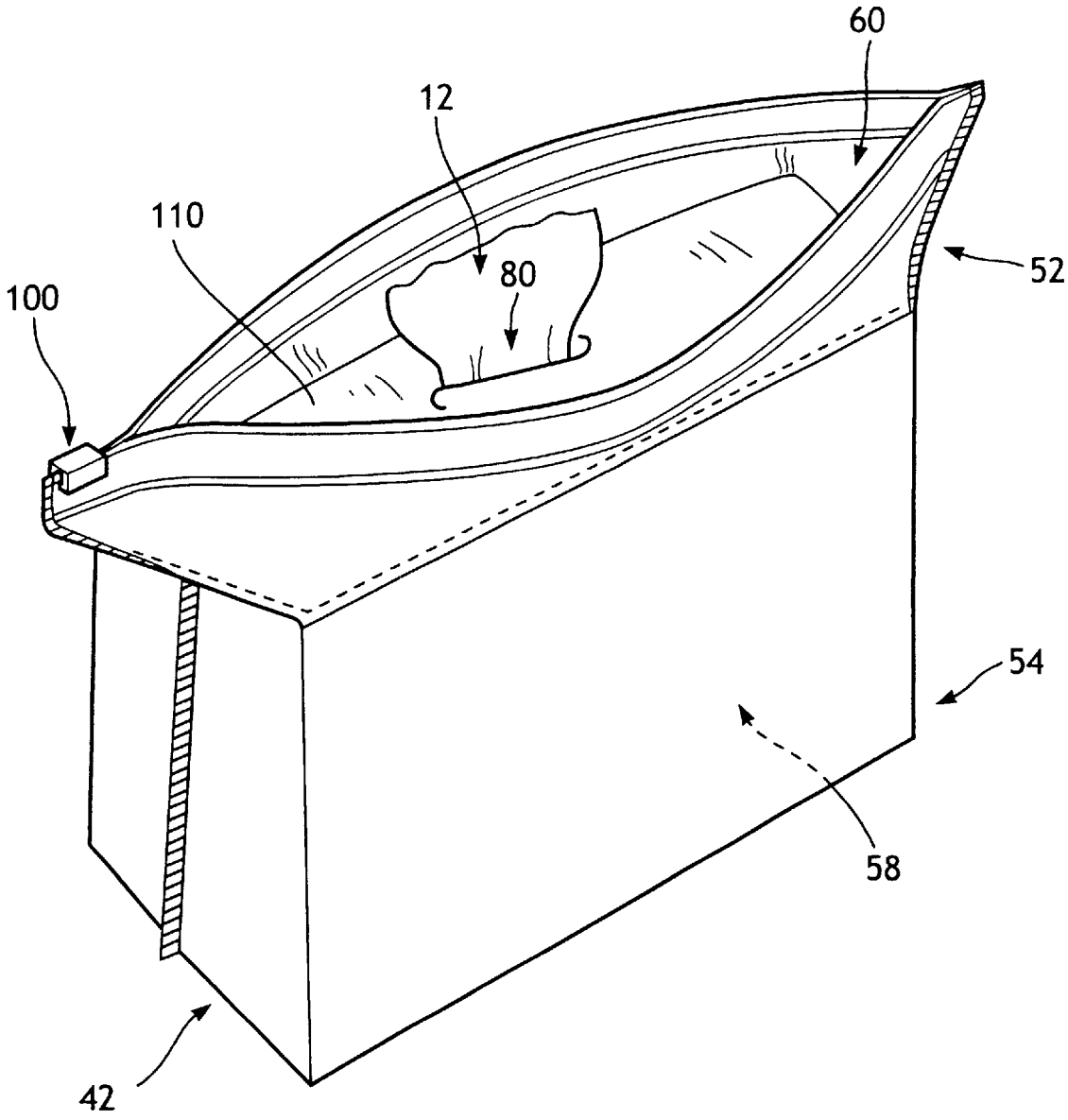
FIG. 13 representatively shows a perspective view of the dispenser of FIG. 12, where a wipe is ready for pop-up dispensing and the dispenser is open.

An example of non-rigid containers for use with the present invention are disclosed in U.S. Ser. No. 09/813,536, filed Mar. 21, 2001 and entitled "STORAGE AND DISPENSING PACKAGE FOR WIPES" and assigned to the assignee of the present application, which prior application is incorporated fully herein by reference. FIGS. 12 and 13 show one such storing and dispensing package 40 for wipes 12. The package 40 includes a non-rigid container 42 having sides 50 with a top end portion 52 and a bottom end portion 54, where the sides and top and bottom end portions define a cavity 56 within the container 42.

The cavity 56 includes a storage portion 58 for wipes 12. The top end portion 52 can include a resealable mechanism 100. A non-rigid baffle structure 110 has a width and is located in between the resealable mechanism 100 and the storage portion 58 with the baffle structure 110 positioned between opposing sides 50 of the container spaced apart from each other. The baffle structure thereby defines a dispensing portion 60 of the cavity 56 overlying the storage portion 58 of the cavity.

As seen in FIG. 12, the resealable mechanism 100 is in a sealed closed position 102, whereas in FIG. 13 it is in an open position with a wipe 12 inside the container ready for pop-up dispensing. The mechanism 100 can be any type of mechanism that allows the package 40 to be opened, closed and reopened multiple times during the life of the package, e.g., a zipper with or without a slider, resealable adhesive, a clip or other structure that achieves the result desired here.

In use, the resealable mechanism 100 is opened and then access to the dispensing portion 60 is gained. The user then passes his or her hand, etc. through the orifice 80 to grab the first wipe in the stack of wipes. If the orifice is a frangible seal, this must be broken before the user can pass his or her hand through the orifice. Once the user grabs the wipe, it can then pass through the orifice and enter the dispensing portion 60 as the user pulls it up. If the user does not immediately need the wipe, it can be left in the orifice partially dispensed where it can be maintained in place by the baffle structure 110 until desired later. The partially dispensed wipe will just rest in place in the orifice, part in the dispensing portion and part in the storage portion, conveniently ready for later dispensing in the pop-up format. If the user does immediately desire to use the wipe, it can pass the complete wipe through the dispensing portion and out of the package. Depending on the configuration of the stack, the next wipe for dispensing may be automatically maintained in the orifice partially dispensed for later use (i.e., in a pop-up dispensing format) or it may need to be fetched out of the storage portion similar to the first wipe at a later time when it is desired, commonly called reach-in dispensing. In either case, after the desired number of wipes are taken, the resealable mechanism can be sealed closed, with or without a wipe partially dispensed in the dispensing portion, as discussed previously.

Figure 14:
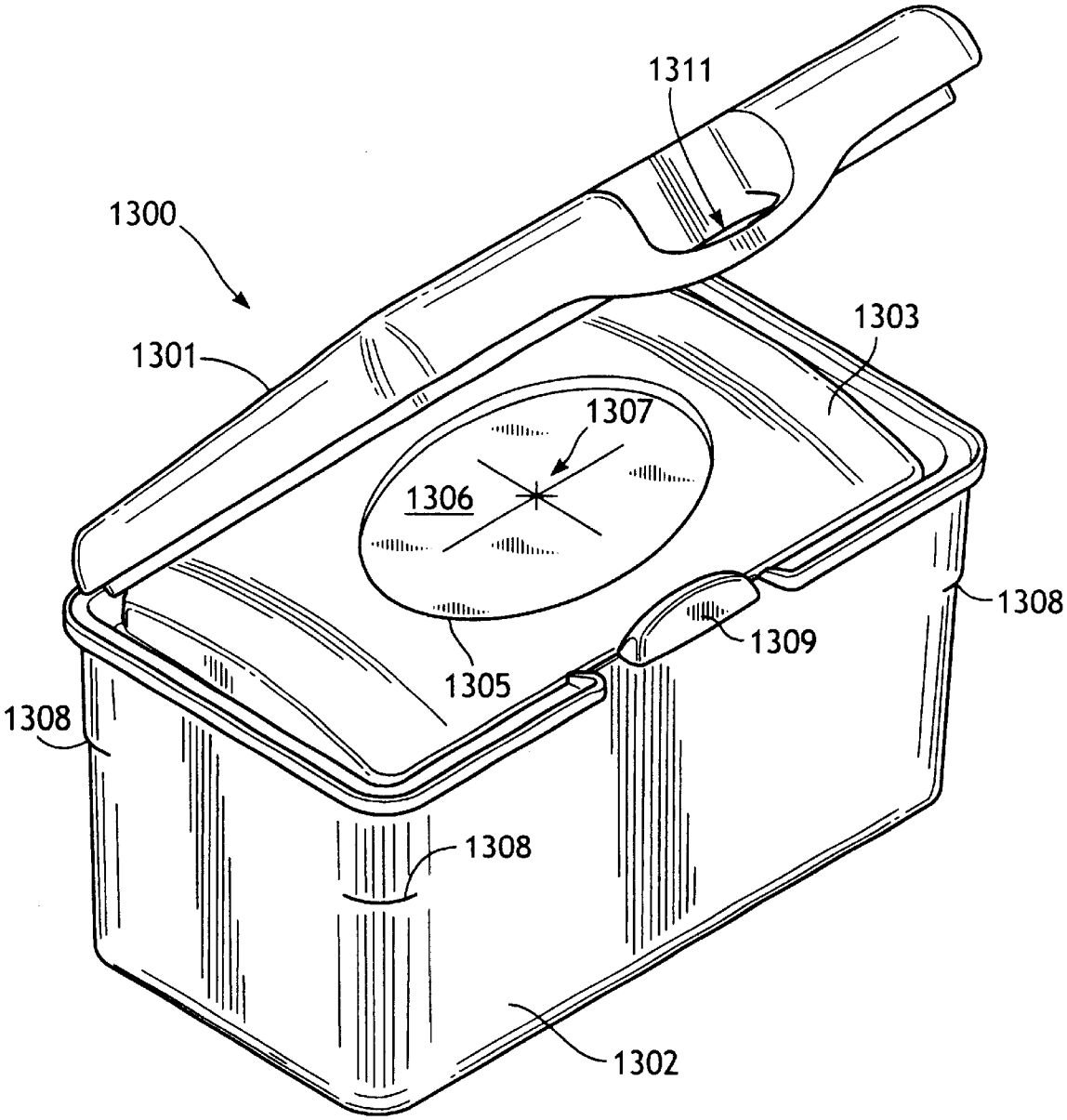
FIG. 14 representatively shows a perspective view of a type of rigid dispenser for use with wipes of the present invention, where wipes are sealed therein and the dispenser lid is open.

An example of rigid containers suitable for use with the present invention are disclosed in U.S. Ser. No. 09/538,711 filed Mar. 30, 2000 entitled "WET WIPE CONTAINER WITH FLEXIBLE ORIFICE" and assigned to the assignee of the present application, which prior application is incorporated fully herein by reference. FIG. 14 shows such a rigid plastic wet wipe dispenser 1300. Dispenser 1300 includes a lid 1301 hingedly attached to a base 1302 and a removable inner cover 1303. The removable inner cover contains a pop-up style wipe dispenser including a rigid port 1305 which surrounds a flexible, rubber-like material or sheet 1306 having a dispensing opening 1307. The dispensing opening 1307 is illustrated as several slits through which individual wet wipes are removed from the container. An alternative sheet configuration and slit configuration that can be employed are disclosed in a U.S. Patent application filed separately but concurrently herewith entitled; "FLEXIBLE ORIFICE FOR WET WIPES DISPENSER" of inventors Yung H. Huang et al., U.S. Ser. No. 09/870,785, assigned to the same assignee of this application and known by attorney docket number 16981A which application is incorporated fully herein by reference. The cover is removably secured to the sidewalls of the base by a small lip around the periphery of the inner cover that engages with notches within several protruding ribs on the inner surface of the sidewalls (not shown). It also rests on a small support surface in each of the four corners of the base, which is outwardly visible by discontinuities 1308 in the rounded corners of the base. The lid is secured in a closed position by a suitable latching mechanism, in which a protrusion 1309 in the front lip of the base is engaged by an opening 1311 in the front lip of the lid. The shape of the rigid port in the embodiment shown in FIG. 14 is oval, but can be any shape and size large enough to enable the user to reach into the container with their fingers to grasp the next available wet wipe in the event of a dispensing failure, or if reach-in dispensing is preferred to further aid in moisture retention of the wipes. As used herein, "reach-in" dispensing is understood to mean having to fetch a wipe out of a container through an opening substantially co-extensive with the walls of the container or through a restricted opening smaller than the perimeter defined by the walls. In either case, the top wipe for dispensing rests on top of the remainder of the stack of wipes and the top wipe needs to be separated from the remainder of the stack each time anew when dispensing is desired. An example of such a reach-in dispenser is found in the currently available baby wipe product sold by Kimberly-Clark Corporation of Neenah, Wis. under the trade name HUGGIES® Supreme Care. Generally, use of dispenser 1300 for dispensing wipes 12 is similar to that for package 40, except when due to obvious structural difference.

Figure 15:
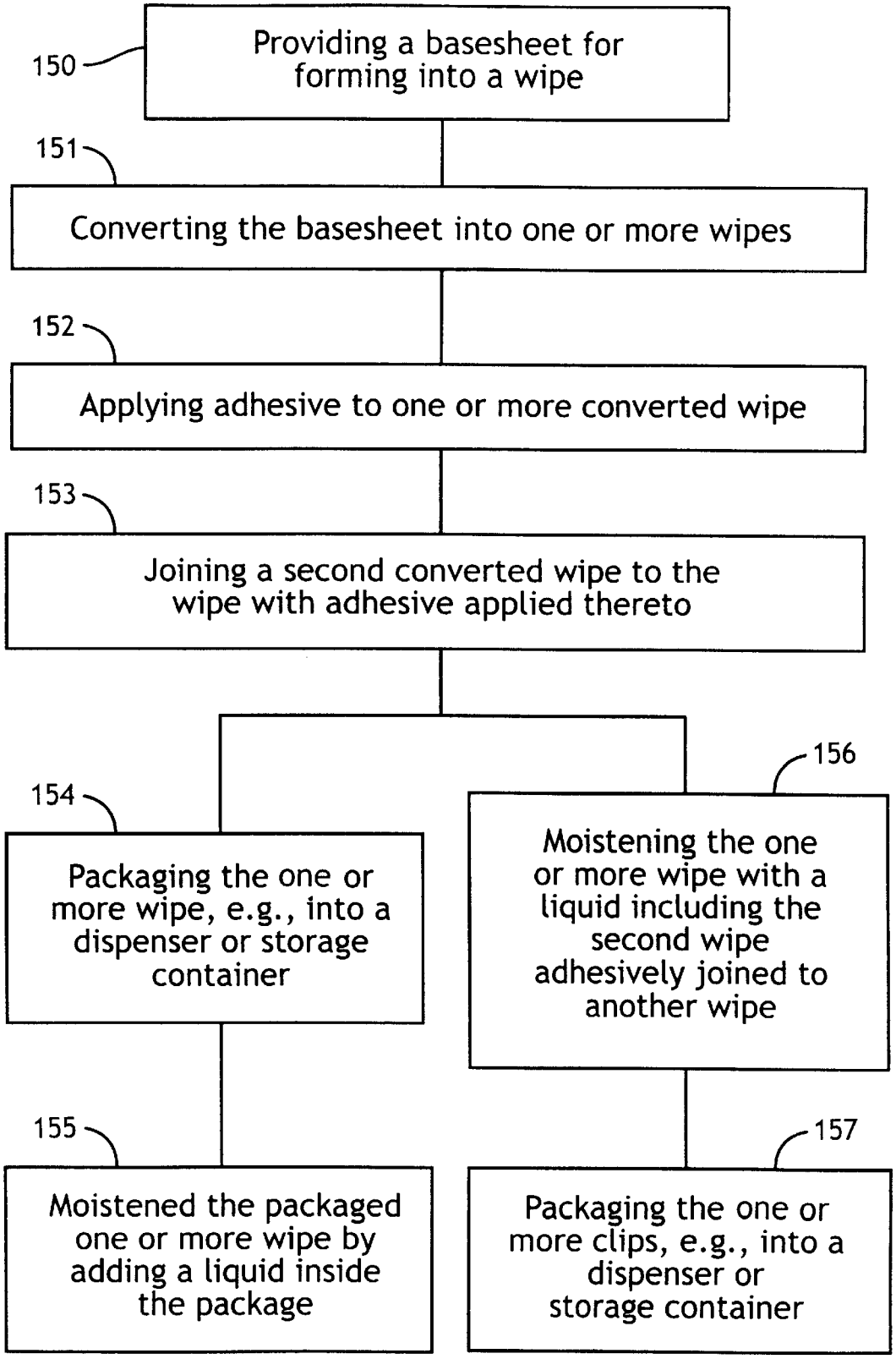
FIG. 15 representatively shows a schematic diagram for making wipes, in accordance with the present invention.
Figure 16:
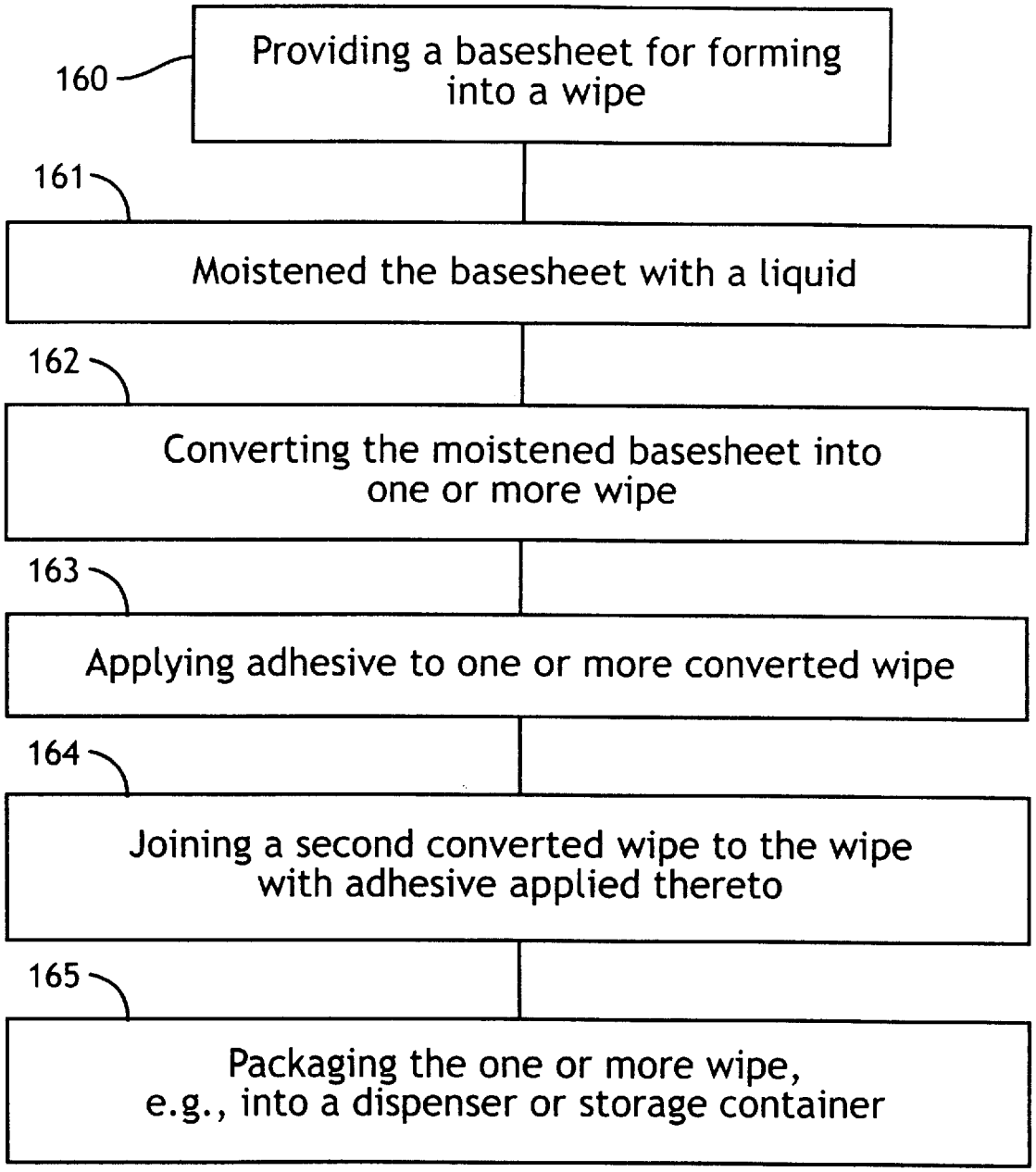
FIG. 16 representatively shows a schematic diagram for alternately making wipes, in accordance with the present invention.

FIGS. 15 and 16 schematically show representative steps for making a plurality 10 of wipes 12 of the present invention. Each of these steps can be specifically performed according to the teachings herein or as would be known to one skilled in the art, depending on particular circumstances. These steps are described as follows, generally in the following order though not required, but rather, dependent upon the circumstances. First steps 150 and 160 are the same, namely, providing a base sheet for forming into a wipe. From there, the steps can diverge. After step 150 is step 151 of converting the base sheet into one or more wipes. This usually includes forming several individual wipes from a large base sheet of wipe material. Near simultaneously with the forming of individual wipes, if the wipes are to be folded or interfolded with another wipe such as to form a clip of wipes, this usually occurs now. Next, adhesive can be applied to the wipes in step 152. This occurs either on an individual wipe basis such as when the wipes are not interfolded and another separably joining together means is not desired, or to the leading wipe within a clip of wipes when two of more wipes are formed as a clip of wipes separable joined together. Next, the second wipe, either an individual second wipe or last wipe of the clip of wipes placed on top of the first wipe of the below clip of wipes, is joined to the first wipe with adhesive applied thereto, in step 153. As used herein "applying" means any way to get adhesive onto the at least two wipes that are adhesively joined together, which can include without limitation, spraying, rolling, squirting, drooling, painting, coating and/or printing. This also includes getting the adhesive onto the two wipes in any order (as between the two wipes being joined by adhesive) or simultaneously. Next, the wipes or stack of wipes are ready for their final steps of 154 to 157 including packaging and moistening, in either order as shown. The wipes are now ready for consumption by a user.

FIG. 16 shows an alternate set of steps for making the wipes of the invention. The principal difference is that here, the basesheet is moistened in step 161 in advance of applying adhesive in step 163. Although converting in step 162 is also shown to follow moistening step 161, steps 161 and 162 can be reversed and they can occur near simultaneously, all dependent upon how many sub-steps are employed in the converting step 162. Such sub-steps are known to those of skill in the art and are often driven by economics or equipment to obtain a desired fold or interfolding of the plurality of wipes. Otherwise, steps 163 to 165 are analogous to above described steps 152, 153 and 154/157 respectively.

FIGS. 15 and 16, in combination with the teachings herein, demonstrate that the adhesive can be applied to the wipes before or after the wipes are moistened with the liquid. However, preferably the wipes can be moistened before adhesive is applied to provide a more uniformly moistened product and/or depending on manufacturing desires. In this regard, although a variety of adhesives are believed to be usable to practice the invention, when adhesive is applied before moistening certain adhesives work better than others and certain adhesives work better on certain types of basesheets than others. Some adhesives are hot melt adhesives such as those known as H2800, H2727A and H2525A, all styrenic block copolymers, and all of Bostik Findley Inc. of 11320 Watertown Plank Road, Wauwatosa, Wis. 53226. Others include RT2715 and RT2730, each an Amorphous Poly Alpha Olefin (APAO), and each available from Huntsman as noted previously. Finally, it should also be understood that some or all of the features of the invention described can be combined, and particular values within ranges selected, as would be known to do to one of ordinary skill in the art based on the teachings of the invention herein.

All publications, patents, and patent documents cited in the specification are incorporated by reference herein, as though individually incorporated by reference. In the case of any inconsistencies, the present disclosure, including any definitions herein, will prevail. While the invention has been described in detail with respect to the specific aspects thereof, it will be appreciated that those skilled in the art, upon attaining an understanding of the foregoing, may readily conceive of alterations to, variations of, and equivalents to these aspects which fall within the spirit and scope of the present invention, which should be assessed accordingly to that of the appended claims.

What is claimed is:

1. A plurality of wet wipes separably joined together comprising:

each wipe of the plurality of wipes moistened with a liquid in an amount of about 25 percent to about 600 percent of a dry weight of the wipe;

an adhesive joining together at least two wipes of the plurality of wipes wherein the adhesive is applied to the at least two wipes after the wipes are moistened with the liquid and wherein the adhesive joins the at least two wipes together with an adhesion strength per unit adhesive length greater than 0 g/cm and less than about 200 g/cm.

2. The wipes of claim 1 wherein the adhesion strength is less than about 150 g/cm.

3. The wipes of claim 1 wherein the adhesion strength is less than about 100 g/cm.

4. The wipes of claim 1 wherein the adhesion strength is less than about 75 g/cm.

5. The wipes of claim 1 wherein the adhesion strength is less than about 50 g/cm.

6. The wipes of claim 1 wherein the adhesion strength is less than about 25 g/cm.

7. The wipes of claim 1 wherein the adhesion strength is less than about 15 g/cm.

8. The wipes of claim 1 wherein the adhesive comprises a substantially continuous strip of adhesive.

9. The wipes of claim 8 wherein the substantially continuous strip of adhesive extends from about a first side of the wipes to about a second side of the wipes.

10. The wipes of claim 1 wherein the plurality of wipes comprises a stack of wipes including at least two clips of separably joined wipes wherein a last sheet of one clip is adhesively joined to a first sheet of a succeeding clip.

11. The wipes of claim 1 in combination with a dispenser or package wherein the dispenser or package is adapted to dispense the plurality of wipes in a pop-up format.

12. The wipes of claim 1 wherein at least a different two wipes of the plurality of wipes are separably joined together without use of the adhesive.

13. The wipes of claim 1 wherein the adhesive is applied to the at least two wipes at an add-on per unit adhesive area greater than 0 g/cm$^2$ and less than about 0.04 g/cm$^2$.

14. The wipes of claim 1 wherein the adhesive is applied to the at least two wipes at an add-on per unit adhesive area greater than 0 g/cm$^2$ and less than about 0.001 g/cm$^2$.

15. The wipes of claim 1 wherein the adhesive is applied to the at least two wipes at an add-on per unit adhesive area greater than 0 g/cm$^2$ and less than about 0.0001 g/cm$^2$.

16. The wipes of claim 1 wherein the adhesive is applied to the at least two wipes at an add-on per unit adhesive area greater than 0 g/cm$^2$ and less than about 0.00003 g/cm$^2$.

17. The wipes of claim 1 wherein the adhesive is applied, at least in part, in a curved pattern.

18. The wipes of claim 1 wherein the adhesive is applied, at least in part, in a swirl pattern.

19. The wipes of claim 1 wherein the adhesive joins the at least two wipes together over an adhesive length equal to or greater than about 7 percent of a width of the wipes.

20. The wipes of claim 1 wherein the adhesive joins the at least two wipes together over an adhesive length equal to or greater than about 25 percent of a width of the wipes.

21. The wipes of claim 1 wherein the adhesive joins the at least two wipes together over at an adhesive location within 75% of a leading edge of the wipes.

22. The wipes of claim 1 wherein the adhesive joins the at least two wipes together over at an adhesive location within 50% of a leading edge of the wipes.

23. The wipes of claim 1 wherein the adhesive joins the at least two wipes together over at an adhesive location within 25% of a leading edge of the wipes.

24. The wipes of claim 1 wherein the adhesive joins the at least two wipes together over at an adhesive location within 10% of a leading edge of the wipes.

25. A plurality of wet wipes separably joined together comprising:

each wipe of the plurality of wipes moistened with a liquid in an amount of about 25 percent to about 600 percent of a dry weight of the wipe;

an adhesive joining together at least two wipes of the plurality of wipes wherein the adhesive joins the at least two wipes together with an adhesion strength per unit adhesive length greater than 0 g/cm and less than about 200 g/cm.

26. A plurality of wet wipes separably joined together comprising:

each wipe of the plurality of wipes moistened with a liquid in an amount of about 25 percent to about 600 percent of a dry weight of the wipe;

an adhesive joining together at least two wipes of the plurality of wipes wherein the adhesive is applied to the at least two wipes after the wipes are moistened with the liquid and wherein the adhesive joins the at least two wipes together with an adhesion strength per unit adhesive area greater than 0 g/cm$^2$ and less than about 1000 g/cm$^2$.

27. The wipes of claim 26 wherein the adhesion strength is less than about 750 g/cm$^2$.

28. The wipes of claim 26 wherein the adhesion strength is less than about 500 g/cm$^2$.

29. The wipes of claim 26 wherein the adhesion strength is less than about 250 g/cm$^2$.

30. The wipes of claim 26 wherein the adhesion strength is less than about 100 g/cm$^2$.

31. The wipes of claim 26 wherein the adhesion strength is less than about 50 g/cm$^2$.

32. The wipes of claim 26 wherein the adhesion strength is less than about 25 g/cm$^2$.

33. The wipes of claim 26 wherein the adhesion strength is less than about 10 g/cm$^2$.

34. The wipes of claim 26 wherein the adhesive comprises a substantially continuous strip of adhesive.

35. The wipes of claim 34 wherein the continuous strip of adhesive extends from about a first side of the wipes to about a second side of the wipes.

36. The wipes of claim 26 wherein the plurality of wipes comprises a stack of wipes including at least two clips of separably joined wipes wherein a last sheet of one clip is adhesively joined to a first sheet of a succeeding clip.

37. The wipes of claim 26 in combination with a dispenser or package wherein the dispenser or package is adapted to dispense the plurality of wipes in a pop-up format.

38. The wipes of claim 26 wherein at least a different two wipes of the plurality of wipes are separably joined together without use of the adhesive.

39. The wipes of claim 26 wherein the adhesive is applied to the at least two wipes at an add-on per unit adhesive area of less than about 0.04 g/cm$^2$.

40. The wipes of claim 26 wherein the adhesive is applied to the at least two wipes at an add-on per unit adhesive area of less than about 0.001 g/cm$^2$.

41. The wipes of claim 26 wherein the adhesive is applied to the at least two wipes at an add-on per unit adhesive area of less than about 0.0001 g/cm$^2$.

42. The wipes of claim 26 wherein the adhesive is applied to the at least two wipes at an add-on per unit adhesive area of less than about 0.00003 g/cm$^2$.

43. The wipes of claim 26 wherein the adhesive joins the at least two wipes together over an adhesive length equal to or greater than about 7 percent of a width of the wipes.

44. The wipes of claim 26 wherein the adhesive joins the at least two wipes together over an adhesive length equal to or greater than about 25 percent of a width of the wipes.

45. The wipes of claim 26 wherein the adhesive joins the at least two wipes together over at an adhesive location within 75% of a leading edge of the wipes.

46. The wipes of claim 26 wherein the adhesive joins the at least two wipes together over at an adhesive location within 50% of a leading edge of the wipes.

47. The wipes of claim 26 wherein the adhesive joins the at least two wipes together over at an adhesive location within 25% of a leading edge of the wipes.

48. The wipes of claim 26 wherein the adhesive joins the at least two wipes together over at an adhesive location within 10% of a leading edge of the wipes.

49. A plurality of wet wipes separably joined together comprising:

each wipe of the plurality of wipes moistened with a liquid in an amount of about 25 percent to about 600 percent of a dry weight of the wipe;

an adhesive joining together at least two wipes of the plurality of wipes wherein the adhesive joins the at least two wipes together with an adhesion strength per unit adhesive area greater than 0 g/cm$^2$ and less than about 1000 g/cm$^2$.

* * * * *